US005238123A

United States Patent [19]

Tovini et al.

[11] Patent Number: 5,238,123

[45] Date of Patent: Aug. 24, 1993

[54] AUTOMATED THICKNESS AND LENGTH DETECTING AND SORTING SYSTEM FOR ENVELOPES

[75] Inventors: Gianluca Tovini; Szee M. Yao, both of Norwalk, Conn.

[73] Assignee: Agissar Corporation, Stratford, Conn.

[21] Appl. No.: 866,875

[22] Filed: Apr. 10, 1992

[51] Int. Cl.[5] ..... B07C 5/00

[52] U.S. Cl. ..... 209/556; 209/604; 209/654; 271/262

[58] Field of Search ..... 209/555, 556, 558, 601, 209/603, 604, 600, 654; 271/262, 263, 258, 265, 2

[56] References Cited

U.S. PATENT DOCUMENTS

| | | | |
|---|---|---|---|
| 2,750,188 | 6/1956 | Rouan | 271/262 |
| 4,030,607 | 6/1977 | Suda et al. | 209/604 |
| 4,576,287 | 3/1986 | Bingham et al. | 209/604 |
| 4,713,831 | 12/1987 | Morisod | 271/262 |

FOREIGN PATENT DOCUMENTS

| | | | |
|---|---|---|---|
| 225288 | 6/1987 | European Pat. Off. | 209/604 |

*Primary Examiner*—Robert P. Olszewski

*Assistant Examiner*—Kenneth Noland

*Attorney, Agent, or Firm*—Melvin I. Stoltz

[57] ABSTRACT

A unique envelope handling and sorting system is attained for efficiently and reliably separating envelopes which fail to meet pre-selected criteria from envelopes meeting these criteria by providing an envelope sensing section having at least one gauging member which comprises a plurality of separate and independent roller assemblies, each of which are securely mounted to an elongated shaft which moves arcuately in response to the thickness measuring movement of the gauging member. In the preferred embodiment, the envelope handling and sorting system of this invention also incorporates means for measuring the length of each envelope and for removing all envelopes that fail to meet the preselected length requirements. In addition, the preferred system incorporates means for effectively dividing the envelope into a plurality of separate zones and enabling the user to select any desired zone for use and evaluation of the envelope thickness measurements. In this way, any areas of the envelope, such as construction seam bearing areas, which may provide erroneous information, are specifically avoided and only the precisely desired areas are used for thickness measurements.

20 Claims, 11 Drawing Sheets

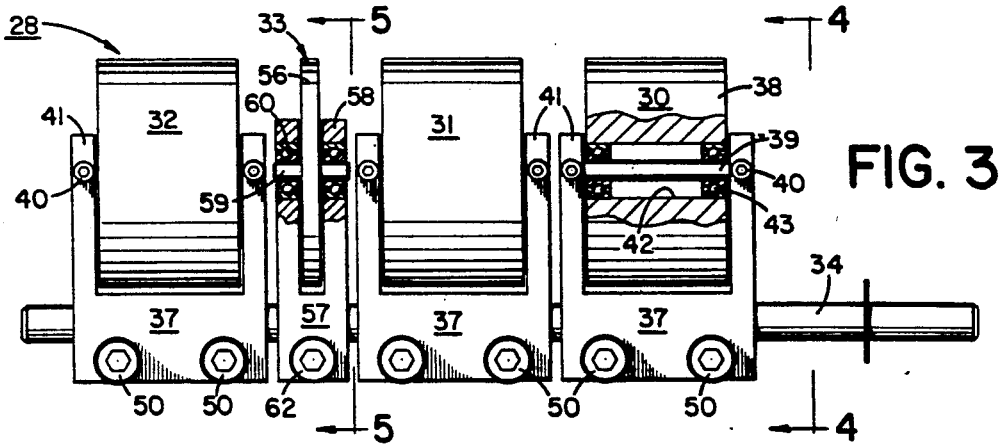
FIG. 3
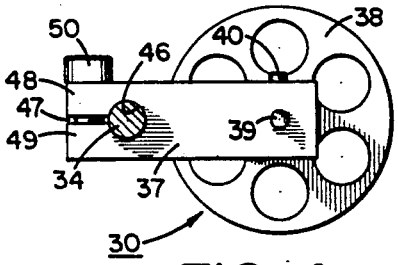
FIG. 4
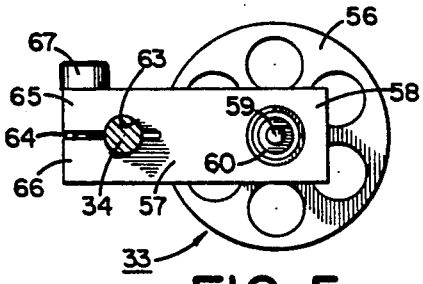
FIG. 5
FIG. 6
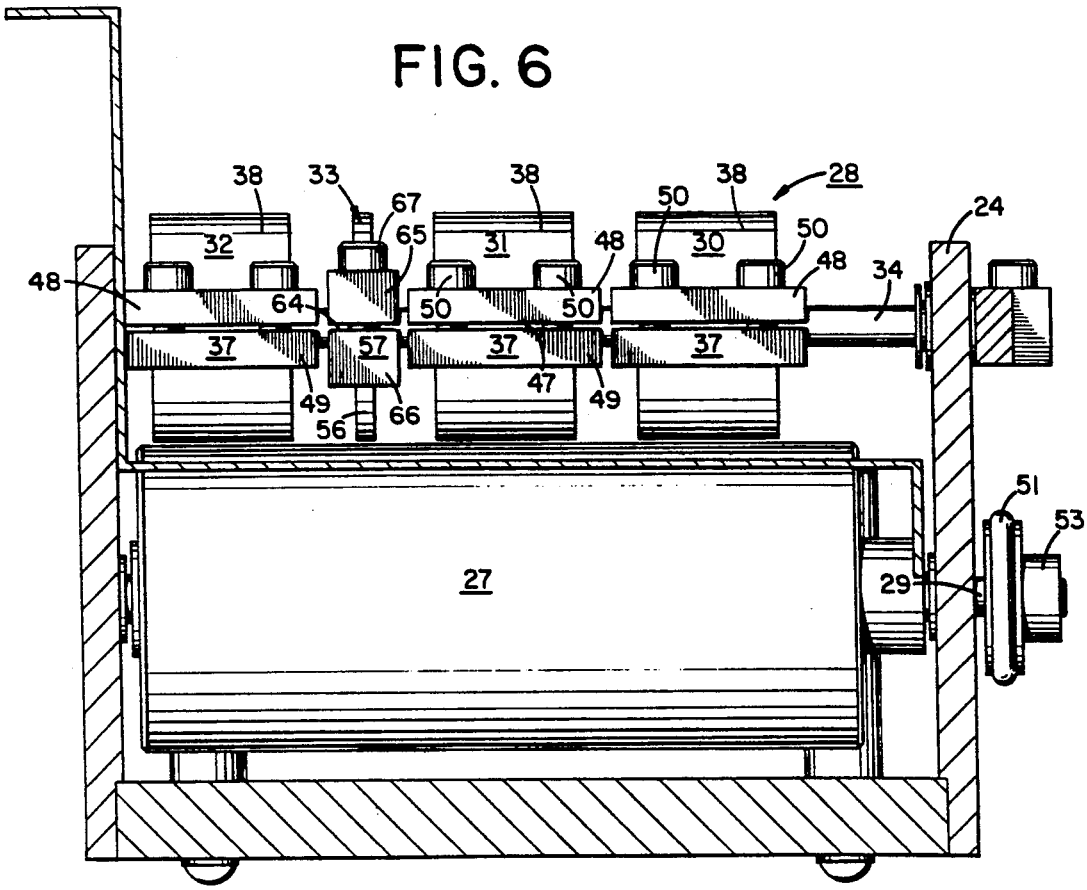

AUTOMATED THICKNESS AND LENGTH DETECTING AND SORTING SYSTEM FOR ENVELOPES

TECHNICAL FIELD

This invention relates to envelope or mail handling systems and, more particularly, to an outsorting assembly for incorporation in a mail handling system for removing envelopes which fail to meet desired thickness and/or length requirements.

BACKGROUND ART

Due to the ever-increasing demand by numerous businesses for efficient mail handling equipment, many systems have been developed in an attempt to automatically receive envelopes, process the envelopes, slit the envelopes open and present the contents of the envelopes in a manner which is most efficiently handled by an operator. Although these prior art systems have been reasonably efficient in receiving the envelopes and slitting the envelopes open, substantial difficulty has been encountered in providing an efficient system capable of pre-processing the envelopes by removing envelopes which require special handling. By providing a system which is able to reliably and consistently outsort unwanted envelopes, the envelopes capable of being handled in the conventional manner are able to be more efficiently processed, with the contents thereof easily and conveniently removed from the envelope for checking and entry by an operator.

Although various prior art systems have been developed in an attempt to satisfy the needs and desires of the industry, these prior art attempts have been unable to provide an envelope handling system which is capable of repeatedly and reliably removing or outsorting envelopes which require special processing or which cannot be expeditiously and efficiently handled along with conventional envelope contents. Typically, prior art systems are unable to provide infinite resolution of an envelope by examining the entire envelope, or selected portions thereof, and not erroneously outsort envelopes due to misreading construction seams, stamps, address labels, etc.

Although various prior art systems have been developed, these prior art systems have failed to provide thickness detectors for efficiently, accurately and repeatedly removing envelopes failing to meet only the particularly desired criteria. Consequently, such prior art attempts have been unable to satisfy the needs of the industry.

In general, these prior art systems have been incapable of repeatedly, reliably, and consistently recognizing envelopes which should be specially handled and effectively removing such envelopes from the stream of envelopes which are able to be processed expeditiously. In addition, these prior art systems have typically incorporated mechanical constructions to determine thickness variations. As a result, these prior art mechanical constructions have been incapable of providing consistent and repeatable results, due to the tendency of such constructions to incur dimensional changes, drift, or hysteresis.

Another problem found in prior art systems, due to the typical construction, is the inability of the prior art thickness detectors to enable the user to select any desired area or zone along the length of the envelope as the site on which the thickness is to be detected. As a result, thickness-affecting factors such as the construction of the envelope, labels, stamps, transparent windows, etc., cannot be avoided and often produce erroneous results.

In most prior art constructions, the envelope passes between a pair of measuring devices, such as rollers, plates, drums, or arms, causing the measuring devices to separate a distance equal to the thickness of the envelope. Unfortunately, this typical construction causes the prior art systems to measure thickness along the entire envelope width. As a result, uncontrollable, non-important variations in the envelope affects the measurements being taken, causing processable envelopes to be erroneously outsorted. Consequently, these prior art systems fail to effectively and efficiently measure the actual contents of the envelope.

Therefore, it is a principal object of the present invention to provide a thickness and length detecting system for automated mail handling systems which is capable of providing effective, efficient, and accurate outsorting of envelopes which fail to meet the precisely defined parameters.

Another object of the present invention is to provide a thickness and length detection system having the characteristic features described above which is capable of complete adjustability to provide infinite resolution of the envelope by enabling the thickness detection to be taken along any desired portion site or zone of the envelope.

Another object of the present invention is to provide a thickness and length detection system for automated envelope handling systems having the characteristic features described above which efficiently and automatically separates all envelopes requiring special handling while advancing all desired envelopes for normal processing.

Another object of the present invention is to provide a thickness and length detection system for use with an automated envelope handling system which is capable of operating continuously and efficiently without manual intervention.

A further object of the present invention is to provide a thickness and length detection system for use with an automated envelope handling system which is completely adjustable for customized use while being easily installed and operated without requiring extensive knowledge or training.

Other and more specific objects will in part be obvious and will in part appear hereinafter.

SUMMARY OF THE INVENTION

By employing the automated thickness and length detecting and sorting system of the present invention, the difficulties and drawbacks found in the prior art have been virtually eliminated. In this invention, the thickness and length of each envelope is precisely, repeatedly and accurately measured using a single, elongated, roller/drum in combination with a multiple-element gauging member. Then, using the electronic analysis circuitry, the precisely measured thickness and length are compared to preset levels for determining whether the envelope should be processed normally or outsorted for special handling.

In the preferred embodiment, the multiple-element gauging member of the thickness detecting system comprises four separate and independent roller assemblies, three of which are substantially identical in construction with similarly sized roller elements, and a fourth assembly incorporating a thin roller or disk element. In addition, each of the four roller assemblies is independently mounted to a single pivot shaft, in adjustable lateral and arcuate movability relative thereto. In this way, the multiple-element gauging member is universally employable and provides precise control and thickness measurement accuracy.

Each of the four separate and independent roller assemblies forming the gauging member is adjustably mounted to the single elongated pivot shaft to enable the user to set a precisely desired gap or distance between each of the roller elements of the roller assemblies and the single, elongated, roller/drum. Once the desired gap or distance has been separately established for each of the roller assemblies, the roller assembly is securely affixed to the pivot shaft, to assure that the pivot shaft will rotate about its central axis in response to the movement of the roller assembly. Once each of the roller assemblies have been securely mounted to the pivot shaft in this way, the entire gauging member is ready for operation.

By employing the present invention, the roller assembly incorporating the thin roller or disk element is positionable relative to the other three roller assemblies at any desired location along the pivot shaft. In this way, the thin roller/disk element is able to serve as the principal envelope thickness detection element and be positioned at any location on the elongated pivot shaft relative to the other three roller assemblies. As a result, any desired narrow band or section of the envelope may be selected for precision thickness measurement.

In the preferred construction, the thin roller/disk of the principal measuring roller assembly comprises an overall width of about one-eighth of an inch, while the roller element of each of the other three roller assemblies comprises an overall width of about fifteen-sixteenths of an inch. In this way, the entire width of every envelope is easily monitored in its entirety, with the single, thin roller/disk assembly providing an accurate measurement of the particular desired narrow zone along each and every envelope being processed.

By employing this invention, the portion of the envelope which is believed to be the most accurate for providing the desired thickness measurement is easily selected and universally employed for each and every envelope. Furthermore, when a different envelope construction or configuration is to be processed, the gauging assembly is quickly and easily readjusted by positioning the principal detection assembly of the gauging member in any desired alternate location.

In the preferred construction, the thin, principal thickness measuring element of the gauging assembly is placed in contact with the lower, elongated roller/drum, so that the entire thickness of each and every envelope passing between these components is measured in its entirety. The remaining elements of the multi-element gauging assembly are preferably positioned at a distance that avoids unwanted outsorts due to stamps, labels, etc, while the presence of a thick item such as a piece of credit card, a paper clip or a staple is detected and causes the envelope to be outsorted.

In this way, most envelopes will be processed without causing the larger roller assemblies to touch the envelope, with the thickness measuring being made by the thin roller assembly along the desired, precise preselected detection zone. However, any material contained in the envelope, which may be outside of the narrow zone, will cause the thickness of the envelope to be greater than normal and will be detected by one or more of the other three roller assemblies.

In addition to providing a fully adjustable gauging member incorporating movable components to assure that precision detection is made along any portion of the envelope, the system of the present invention also incorporates electronic measuring and analyzing means for receiving the arcuate movement of the gauging member and converting the arcuate movement to a precision thickness measurement. Then, using a plurality of preset threshold levels, the thickness measurement is analyzed to determine whether the envelope should be processed in a normal manner or outsorted for special handling.

In addition, the system of the present invention also incorporates electronic circuitry for dividing the length of the envelope into a plurality of zones.which an be employed as either by-pass zones or content detection zones. In this way, any specific areas of the envelope which could produce abnormal thickness measurements, due to extraneous factors such as construction seams, stamps, labels, etc., can be filtered out from the actual thickness measurement and content determinations.

By employing this invention, only those zones of the envelope which normally are reasonably free of extraneous material and have the most accurate envelope thickness measurement capabilities are precisely selected for use in determining whether the envelope should be sorted in the normal manner or outsorted for special handling. As a result, an extremely efficient, precise and accurate detection system is attained, wherein all variables which otherwise could lead to erroneous results are effectively eliminated from having any effect on the evaluation of the envelope thickness and its contents.

In order to further provide universal applicability, the system of this invention also incorporates clock means employed for measuring time duration of outsort conditions, as well as additional clock means for measuring the overall length of the envelope. In this way, only envelopes satisfying preselected criteria are processed in the normal fashion, while any envelopes exceeding this criteria are automatically outsorted for special handling.

Finally, the system of the present invention incorporates automatic envelope handling means constructed for individually directing each envelope based upon the resulting analysis obtained regarding the thickness, contents and length of the envelope. Once an envelope has passed through the thickness detection portion of the system of the present invention, the envelope is automatically transferred to the sorting section, wherein the envelope is automatically passed to normal processing if all of the preselected criteria for the envelope have been satisfied. However, in those situations where the envelope fails to meet the preselected criteria, the sorting section automatically transfers the envelope to an outsort section, wherein all envelopes requiring special handling are accumulated.

In the preferred construction, the envelope sorting section comprises a plurality of rollers normally driven in the direction to cause the envelope to be passed to conventional processing. The envelope is placed in a position overlying the rollers which slightly protrude from the support track. Consequently, the rollers in and of themselves are unable to cause the envelope to move in any particular direction. However, once the envelope is in the desired position and has passed the thickness detection analysis, cooperating pinch rollers are lowered causing the envelope to contact the directing rollers, forcing the envelope to be moved to normal processing.

In those situations when an envelope fails to meet the preselected criteria, the movement directing rollers are caused to rotate in the opposite direction prior to the movement of the pinch rollers. Consequently, when the pinch rollers are lowered onto the envelope, causing the envelope to contact the directing rollers, the envelope is forced to move in the alternate direction, into the outsort zone. In this way, an efficient, repeatable, and dependable construction is established which is capable of providing accurate thickness measurement, length determination, detection and analysis, while also efficiently directing each and every envelope to the precisely desired location for subsequent processing.

The invention accordingly comprises the features of construction, combinations of elements, and arrangement of parts which will be exemplified in the construction hereinafter set forth, and the scope of the invention will be indicated in the claims.

THE DRAWINGS

For a fuller understanding of the nature and objects of the invention, reference should be had to the following detailed description, taken in connection with the accompany drawings, in which:

FIG. 3 is a top plan view, partially in cross-section, showing the multiple-element gauging assembly employed in the thickness detection system of the present invention;

FIG. 4 is a side elevation view of one of the elements of the gauging assembly of the FIG. 3, taken along line 4—4 of FIG. 3;

FIG. 5 is a side elevation view of another element of the gauging assembly shown in FIG. 3, taken along line 5—5 of FIG. 3;

FIG. 6 is an end elevation view of the thickness detection system of the present invention taken along line 6—6 of FIG. 8;

DETAILED DESCRIPTION

Figure 1:
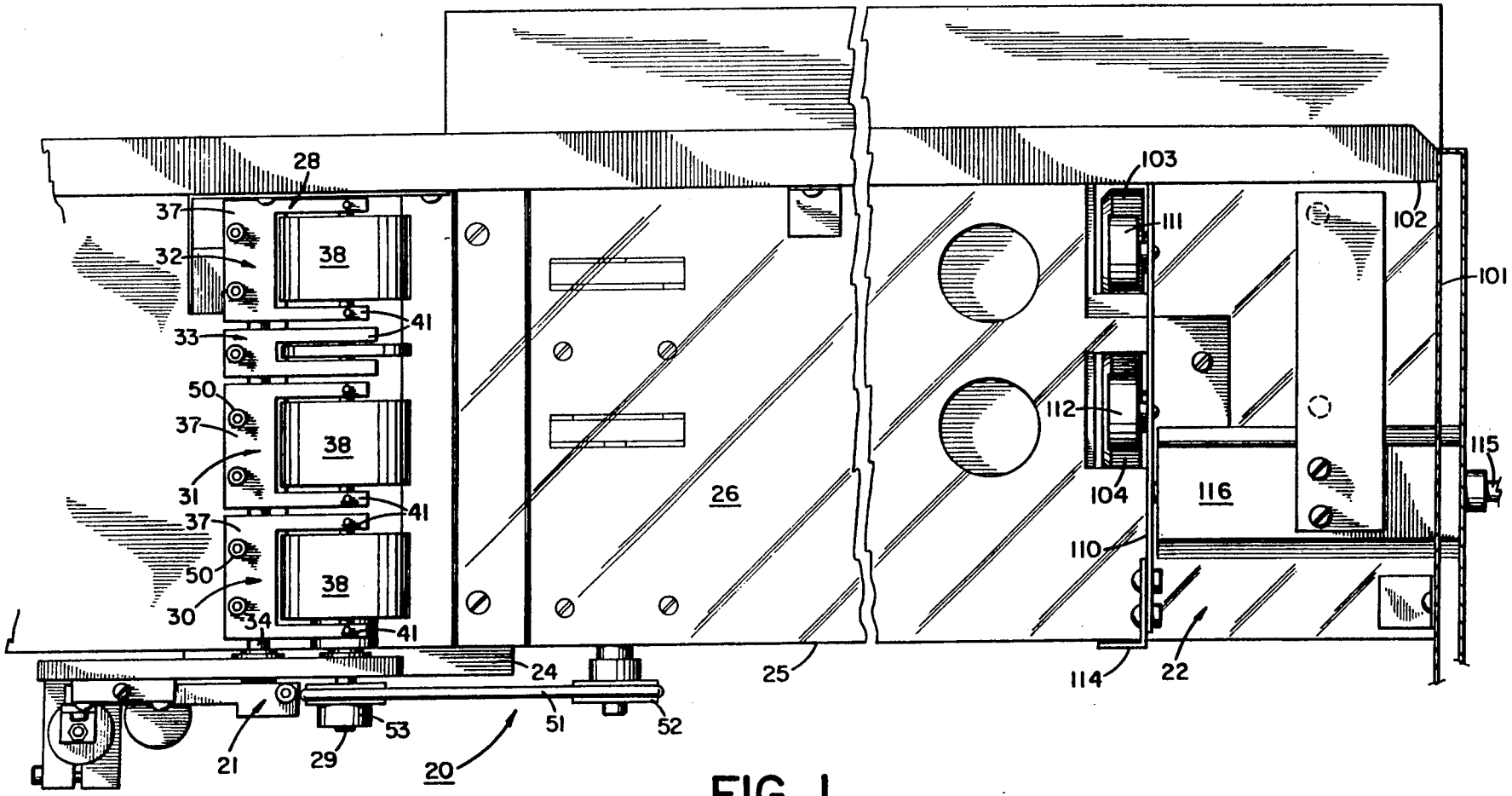
FIG. 1 is a top plan view, partially in cross-section, and partially broken away, of the thickness detection system of the present invention.
Figure 2:
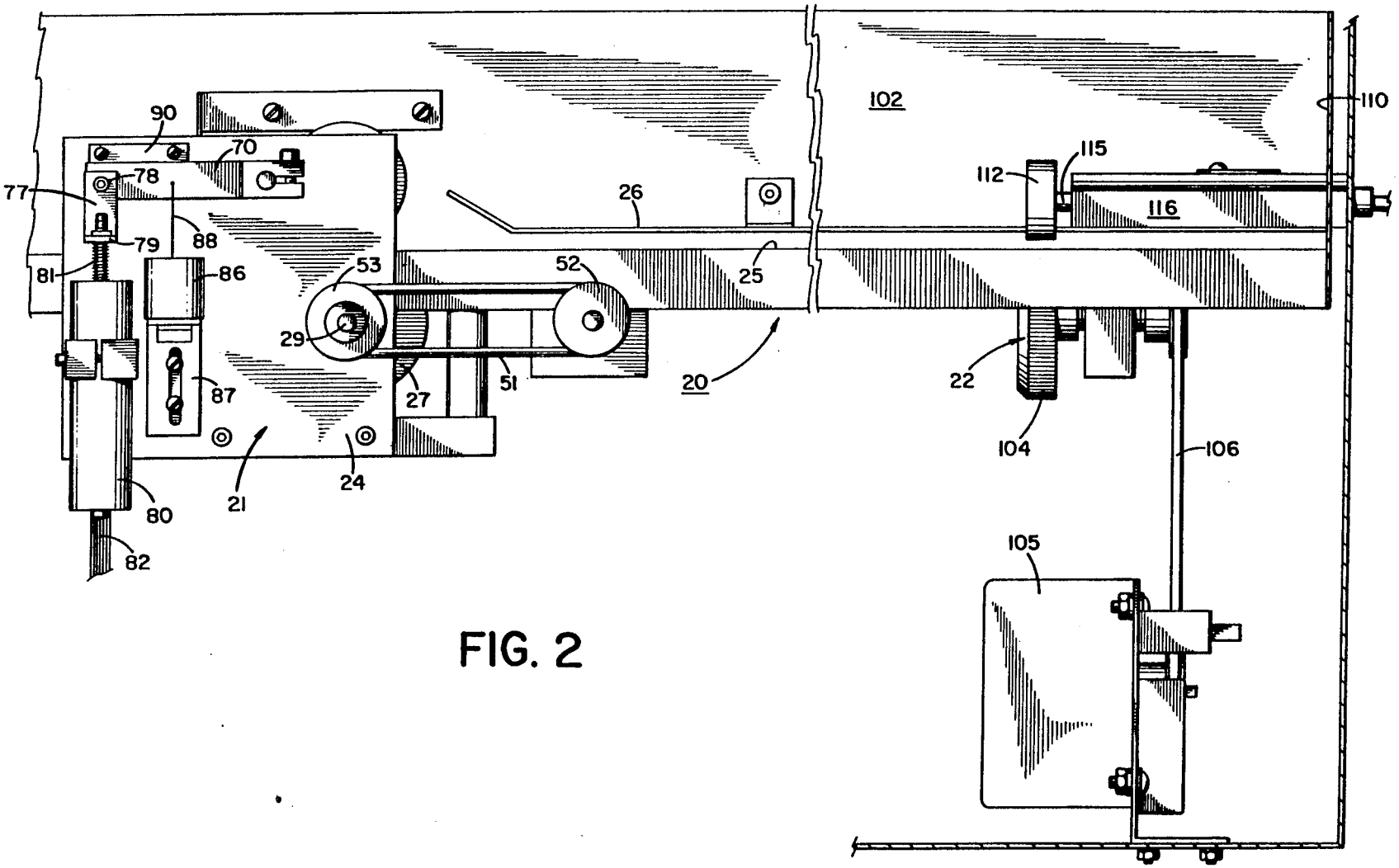
FIG. 2 is a side elevation view, partially broken away, and partially in cross-section, of the thickness detection system shown in FIG. 1.

In FIGS. 1 and 2, the overall construction for the preferred embodiment of thickness detection system 20 of the present invention is shown. In this preferred embodiment, thickness detection system 20 comprises an envelope sensing section 21 and an envelope sorting section 22.

As shown in the drawings, thickness detection system 20 comprises an elongated envelope carrying transfer surface 25 which is formed as an elongated, substantially planar, horizontally disposed track extending the entire length of thickness detection system 20. Furthermore, as shown in FIGS. 1 and 2, thickness detection system 20 is constructed with envelope sensing section 21 mounted at the proximal end of track 25, while envelope sorting section 22 is mounted at the terminating, distal end of track assembly 25. As is fully detailed below, envelopes preferably travel along track 25 lengthwise or longitudinally, enabling the entire length of the envelope to be checked by envelope sensing section 21.

In addition, a planar shield 26 is preferably employed, positioned in juxtaposed spaced facing relationship above track 25, in order to limit unwanted upward movement of any envelopes traveling along track 25. Preferably, shield 26 is formed from transparent sheet material in order to protect the envelopes, while also allowing visual observations of the envelopes as they travel along track 25.

In order to provide the desired accurate, infinitely adjustable, precision thickness sensing attainable with detection system 20 of this invention, envelope sensing section 21 incorporates support or bearing plate 24 in which a lower, cylindrically-shaped roller or drum 27 and an upper, multiple-element gauging assembly 28 are mounted. As detailed below, upper multiple-element gauging assembly 28 and lower roller/drum 27 are mounted in juxtaposed, spaced, cooperating relationship with each other to provide the desired precision thickness measurement of envelopes passing therebetween.

In this embodiment, lower roller/drum 27 comprises a single, elongated, cylindrically shaped member mounted for rotation about axial shaft 29. Preferably, roller 27 is continuously rotated about its central axis by a motor (not shown) which directly drives pulley 53 mounted to shaft 29 through drive belt 51 and pulley 52.

As best seen in FIGS. 1 and 3–6, upper multiple-element, thickness detecting gauging assembly 28 comprises four separate and independent roller/drum subassemblies 30, 31, 32 and 33. Each roller/drum subassembly is independently securely affixed to elongated pivot shaft 34 in the manner detailed below, enabling each independent roller/drum subassembly to be precisely positioned in an exact orientation relative to lower roller/drum 27. In this way, precision, accurate, dependable, and completely repeatable thickness detection is obtained.

Although roller/drum subassembly 30 may be constructed in a plurality of alternate ways, the preferred construction comprises a U-shaped mounting plate 37, incorporating a pair of support arms 41 and an enlarged, cylindrically shaped roller or drum 38. In this construction, roller/drum 38 is rotationally mounted to support arms 41 of mounting plate 37.

In addition, as shown in FIG. 4, roller or drum 38 preferably comprises a plurality of parallel, elongated, through holes formed therein, in order to reduce the overall weight of roller/drum 38. In this way, roller/drum 38 is more responsive to being rotationally moved when contacted by an envelope while eventual overtravels caused by inertia are minimized.

Furthermore, support rod 39 is preferably securely retained in mounting plate 37 by screw means 40 which are threadedly engaged in roller support arms 41, in holding contacting engagement with support rod 39. In addition, in this embodiment, roller 38 incorporates an elongated, centrally disposed cavity or bore extending along the central axis of roller 38, through which support rod 39 is securely retained. In order to assure complete rotational freedom and ease of movement of roller 38 about rod 39, a pair of bearing assemblies 42 are mounted at both ends of elongated bore 42 of roller 38.

In order to securely mount roller/drum subassembly 30 to elongated pivot shaft 34 in the precisely desired spaced orientation relative to lower roller/drum 27, mounting plate 37 incorporates an elongated, shaft receiving bore 46 formed therein which comprises a diameter slightly greater than the outside diameter of shaft 34. In addition, in order to assure ease of assembly, positioning, and securement, mounting plate 37 also incorporates an elongated slot 47 extending from the side edge of plate 37 to elongated bore 46, forming flexible fingers 48 and 49 adjacent shaft receiving bore 46.

The construction of mounting plate 37 is completed by mounting screw means 50 in rotational interengagement with flexible finger 48 and threaded interengagement with flexible finger 49. In this way, by rotationally adjusting screw means 50, the desired secure, affixed, clamped interengagement of plate 37 to shaft 34 is easily attained, enabling plate 37 to be securely mounted to elongated shaft 34 in any precisely desired position or orientation relative to roller/drum 27.

In the preferred embodiment, rollers/drum subassemblies 31 and 32 are constructed in a manner substantially identical to roller/drum subassembly 30 and are securely mounted to elongated shaft 34 using the identical construction detailed above for roller/drum subassembly 30. As a result, the identical numerical references detailed above in reference to roller/drum subassembly 30 are employed for roller/drum subassemblies 31 and 32.

As clearly detailed in the drawings, roller/drum subassemblies 30, 31 and 32 comprise rollers/drums which are substantially identical in overall size and shape. When the roller/drum subassemblies are mounted to shaft 34, a substantially portion of upper, multiple-element gauging assembly 28 is formed. However, by employing the plurality of separate, independent, roller/drum subassemblies 30, 31, and 32, the position of the subassemblies on shaft 34 can be altered to provide thickness detection along any desired portion of the envelope passing between roller/drum subassemblies 30, 31 and 32 and roller/drum 27. Furthermore, as is more fully detailed below, the precise distance between rollers 38 of subassemblies 30, 31 and 32 is completely adjustable in order to enable the user to establish any desired criteria for measuring the thickness of envelopes passing between roller subassemblies 30, 31, and 32 and lower roller 27.

In the preferred embodiment, fourth roller subassembly 33 completes the construction of upper, multiple-element gauging assembly 28. In its preferred configuration, roller subassembly 33 is constructed in a manner substantially similar to roller subassemblies, 30, 31 and 32. However, roller subassembly 33 comprises a cylindrically shaped disk or roller 56 as the principal thickness measuring gauging component of roller subassembly 33.

Preferably, the axial length of roller/drum 38 of roller subassemblies 30, 31, and 32 is between about five to ten times greater than the axial length of roller/disk 56 of subassembly 33. In this way, controlled thickness detection of precisely desired zones is attained.

As shown in the drawings, roller/disk subassembly 33 is securely affixed to elongated, pivot shaft 34 in a manner which enables roller/disk subassembly 33 to be precisely positioned in the exact orientation desired relative to lower roller/drum 27. In addition, roller/disk subassembly 33 is positionable on shaft 34 in any desired position relative to roller/drum subassemblies 30, 31 and 32. As a result, any desired configuration and any desired envelope area is sensed at the precisely desired location.

Although roller/disk subassembly 33 may be constructed in a plurality of alternate ways, the preferred construction is substantially similar to the construction detailed above relative to roller subassemblies 30, 31, and 32. As a result, roller/disk subassembly 33 preferably comprises a U-shaped mounting plate 57 incorporating a pair of support arms 58, 58. In this construction, a roller or disk 56 is freely rotationally mounted to support arms 58 of mounting plate 57 by support rod 59.

Preferably, bearing assemblies 60, 60 are securely mounted in each of the support arms 58 in juxtaposed, spaced, facing relationship with each other. In addition, support rod 59 is frictionally mounted to roller/disk 56 forming the axis thereof, and rotationally journaled in bearing assemblies 60, 60. In this way, roller/disk 60 is freely rotationally mounted to mounting plate 57, capable of free, easy axial rotation about the axis defined by support rod 59 due to the presence of bearing assemblies 60, 60.

Mounting plate 57 preferably incorporates an elongated, shaft-receiving bore 63 extending through mounting plate 57 to enable mounting plate 57 to be securely affixed to axial shaft 34. In addition, in a similar manner as detailed above in reference to mounting plates 37, mounting plate 57 incorporates an elongated slot 64 extending from the side edge of plate 57 to elongated bore 63, forming flexible fingers 65 and 66, positioned in cooperating relationship with shaft receiving bore 63.

The construction of mounting plate 57 is completed by mounting screw means 67 in rotational interengagement with flexible finger 65 and in threaded interengagement with flexible fingers 66. In this way, by rotationally adjusting screw means 67, the desired, secure, affixed, clamped interengagement of mounting plate 57 to shaft 34 is easily attained, enabling plate 57 to be securely affixed to elongated shaft 34 in any desired position or orientation relative to roller/drum 27.

By employing upper, multiple-element gauging assembly 28 in association with lower roller/drum 27, a unique, completely flexible, precision thickness detection construction is realized, enabling the user to precisely select any desired zone of the envelope as the area along which the thickness is to be detected. In addition, the parameters or thickness level being sensed can be varied for different locations along the envelope, thereby achieving a universally adjustable system employable with any envelope construction or configuration.

As is apparent from the preceding detailed disclosure, roller subassemblies 30, 31, 32, and 33 are independently movable and adjustable in a plurality of alternate directions and orientations. In this way, the distance between roller/drum 27 and the thickness sensing elements of roller subassemblies 30, 31, 32 and 33 is independently controllable, as well as the position of each roller subassembly along shaft 34 and the relative position to each other. As a result, universal adjustability is attained and a system employable with all envelopes is realized.

By employing the construction of this invention, areas of the envelopes passing between upper multiple element gauging assembly 28 and lower/roller drum 27 may be precisely selected for detection along any such desired longitudinal zone. In the preferred embodiment, roller subassembly 33 is employed as the principal thickness detecting or envelope gauging member and is preferably mounted to shaft 34 in position touching lower roller/drum 27. In this way, the entire thickness of the envelope passing between roller subassembly 33 and roller/drum 27 is precisely measured along the thin zone defined by roller/disk 56, with roller/disk 56 being positioned to measure the precise location where maximum detection is likely and/or the least possible interference from construction seams or uncontrollable factors should be found.

The remaining roller subassemblies 30, 31, and 32 are each preferably mounted on shaft 34 spaced away from roller/drum 27 by the identical distance. In the preferred embodiment, this distance equals about four sheets of paper, which has been found to provide the best possible compromise between the need of not being affected by stamps, labels, envelope construction, etc., while still being close enough to the envelope surface so that any extraneous item contained in the envelope will be detected.

By employing the construction of this invention, any envelope containing extra material, such as a credit card or folded note, which may not be detected by roller subassembly 33, causes the envelope to have a thickness greater than a conventional envelope. As a result, roller subassemblies 30, 31, 32, and/or 33 are displaced or rotated about shaft, 34 by the increased thickness of the envelope.

As is apparent from the preceding detailed disclosure, upper multiple-element gauging assembly 28 cooperates with lower roller/drum 27 to provide the desired thickness detection. As each envelope passes between these two components, the thickness of the envelope is precisely measured by the movement of roller subassemblies 30, 31, 32 and 33.

Whenever the thickness of an envelope is greater than the spaced distance between roller/drum 27 and one or more roller subassemblies 30, 31, 32 or 33, the particular roller subassembly is forced to move upwardly, away from lower roller/drum 27. This movement causes elongated shaft 34 to pivot about its axis, which movement, as detailed below, causes thickness detection system 20 of this invention to convert the arcuate movement into a precise measurement of the thickness of the envelope.

As best seen in FIGS. 1,2,7, and 8, pivot shaft 34 is affixed at one of its terminating ends to movable arm 70 in a manner which causes movable arm 70 to pivot about the central axis of shaft 34 in response to the rotation of shaft 34 due to the movement of roller subassemblies 30, 31, 32, and 33. In the preferred embodiment, movable arm 70 comprises a shaft receiving bore 71 formed near its proximal end, along with a slot 72 extending from the proximal end of arm 70 to shaft receiving bore 71, forming flexible fingers 73 and 74. Finally, by rotationally mounting screw means 75, in flexible finger 73 and threadedly interengaging screw means 75 in flexible finger 74, the secure, affixed mounted interengagement of movable arm 70 with shaft 34 is attained, in a manner similar to the mounted interengagement detailed above in reference to mounting plates 37 and 57 with shaft 34.

In completing the assembly of movable arm 70, L-shaped bracket 77 is pivotally mounted to the distal end of arm 70 by screw means 78. In this preferred embodiment, L-shaped bracket 70 is freely pivotable about screw means 70 in order to enable bracket 77 to pivot about the central axis of screw means 78 during the movement of arm 70.

In order to provide the direct conversion of the arcuate movement of pivot axis 34 into an electrical signal capable of being analyzed and compared to the desired parameters, thickness detection system 20 of this invention incorporates linear variable differential transformer (LVDT) system 80 which is preferably mounted to bearing plate or sidewall 24 of envelope sensing section 21.

LVDT system 80 is constructed with elongated shaft 81 extending from one end thereof and signal transmitting wires 82 extending from the opposed end thereof. As is known to one of ordinary skill in the art, LVDT system 80 is constructed to be responsive to any axial movement of shaft 81 to convert the axial movement into output signals transmitted on wires 82. As detailed below, the signals transmitted from LVDT system 80 are employed to determine the precise thickness of the envelope passing between multiple-element gauging assembly 28 and lower roller/drum 27. In addition, by employing the output signals from LVDT system 80, a determination is made as to whether the envelope is a conventional envelope to be transmitted to ordinary processing or constitutes an envelope which exceeds the parameters desired and should be outsorted for special handling.

In order to assure that the thickness detecting movement of roller subassemblies 30, 31, 32, and 33 are transmitted to LVDT system 80 for processing and output generation, shaft 81 of LVDT system 80 is threadedly engaged in flange 79 of L-shaped bracket 77 and securely retained in the desired position by lock nut 84. In this way, any arcuate movement of arm 70, in response to the rotational movement of pivot shaft 34, causes bracket 77 to move downwardly pushing shaft 81 into LVDT system 80 for analysis and signal generation. In the preferred embodiment, a spring member 83 is positioned between LVDT system 80 and the lower surface flange 79 of bracket 77, urging bracket 77 and arm 70 upwardly into its normal, thickness detecting position and keeping the roller subassembly 33 in constant contact with the envelope.

In order to assure ease of operation and accurate, repeatable thickness detecting capabilities, envelope sensing section 21 of thickness detection system 20 preferably comprises oscillation dampening means. In this way, the system is able to provide continuous, repeatable detection of the thickness of envelopes rapidly and efficiently.

In the preferred construction, the dampening means employed in the present invention comprises an oscillation dampener or dash pot 86 which is mounted to bearing plate or support wall 24 by adjustable bracket assembly 87. By employing bracket assembly 87, the positioning of dash pot 86 in the precisely desired location relative to movable arm 70 is assured. In this embodiment, dash pot 86 is physically interconnected to movable arm 70 by rod 88, which extends from dash pot 86 to a receiving hole formed in arm 70.

By employing this construction, any movement of arm 70 causes rod 88 to enter dash pot 86, compressing the piston construction formed therein. Once arm 70 is able to pivot back to its original position, due to the removal of the envelope from roller/drum 27 and gauging assembly 28, dash pot 86 and rod 88 enables arm 70 to move quickly to its original position, without incurring repeating oscillations of lowering amplitudes, which might otherwise occur.

The construction of envelope sensing section 21 is completed, in this preferred embodiment, by employing a stop means 90 mounted to support plate 26 of envelope sensing section 21. Stop means 90 is mounted directly above movable arm 70 to prevent arm 70 from arcuately pivoting beyond its normally stopped or ready position. In this way, unwanted oscillation or arcuate movement of arm 70 is further reduced as well as pressure and subsequent wear between rollers 30 and 38 and roller drum 27 is greatly reduced.

Figure 8:
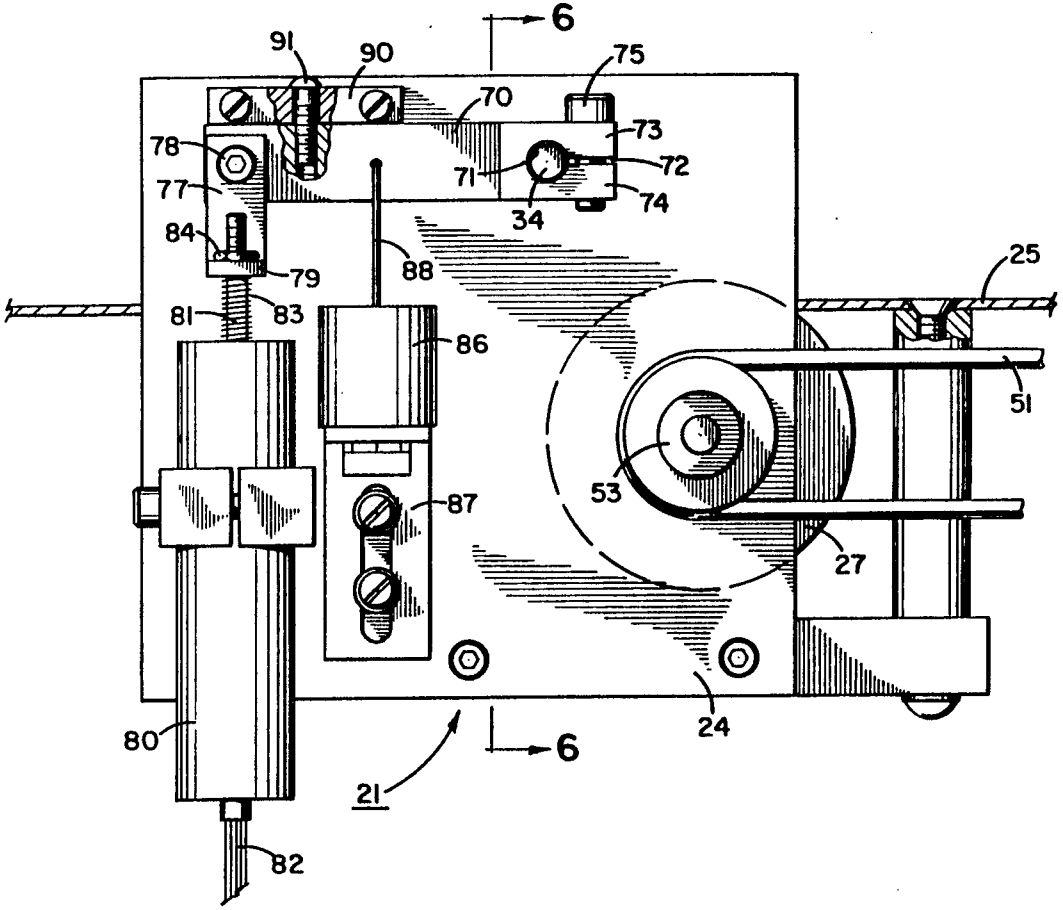
FIG. 8 is a side elevation view of the envelope sensing section of the thickness detection system of FIG. 1 partially in cross-section and partially broken away.
Figure 7:
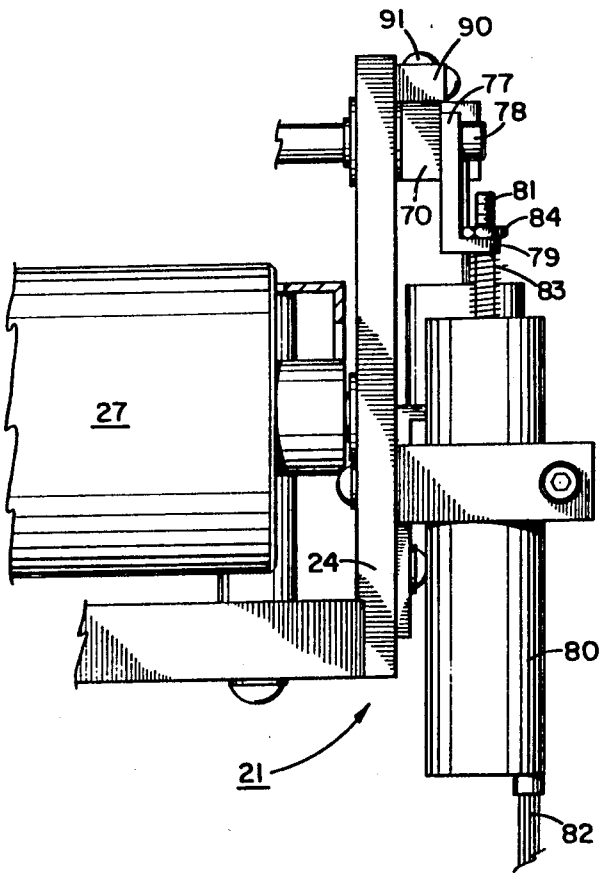
FIG. 7 is an end elevation view, partially broken away, of the envelope sensing section of the thickness detection system of FIG. 2.
Figure 9:
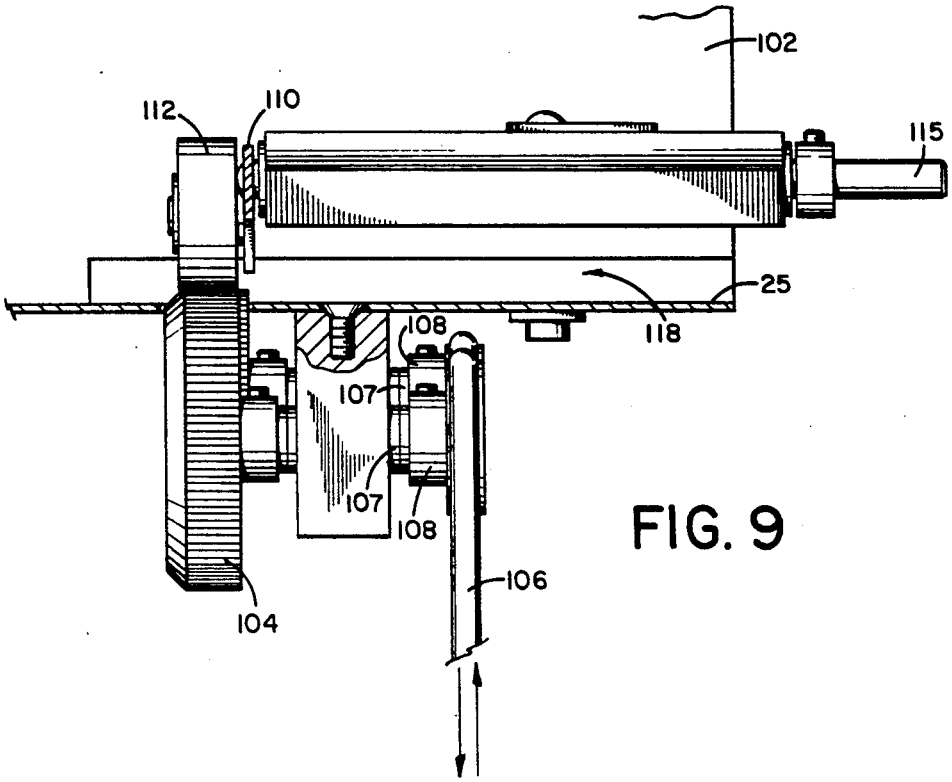
FIG. 9 is a side elevation view of the envelope sorting section of the thickness detection system of FIG. 2, partially broken away.

As shown in FIGS. 7 and 8, screw means 91 is threadedly engaged with stop means 90 in movable arm 70 for use during shipment and initial assembly and adjusting. In this way, the movement of arm 70 during shipment or initial installation is prevented and unwanted damage to LVDT system 80 and dash pot 86 is prevented. However, once thickness detection system 20 of the present invention has been installed and fully adjusted in the desired operational mode, screw means 91 is removed and discarded.

Although envelope sensing section 21 can be constructed in a variety of alternate ways in order to attain the desired precision, accurate, envelope thickness detection, the preferred construction has been detailed above. By employing this construction, any arcuate rotation of shaft 34 is immediately transferred to axially movable shaft 81 and LVDT system 80. However, if desired, alternate structural changes can be made to attain a similar accurate sensing detection, without departing from the scope of the present invention.

In order to optimize the thickness detecting capabilities of envelope sensing section 21 of the present invention, the preferred construction places rollers 38 of roller subassemblies 30, 31, and 32 at a spaced distance from roller/drum 27 which is substantially equal to the distance provided by four thicknesses of paper. In order to precisely attain this desired spacing distance, four sheets of paper are placed between roller/drum 27 and rollers 38 of each of these subassemblies, while mounting bracket 37 is adjusted relative to shaft 34 to securely affix mounting bracket 37 of each of the roller subassemblies to shaft 34 with rollers 38 in the precisely desired position.

As detailed above, the secure mounted, fixed positioning of each of the roller assemblies is attained by adjusting screw means 50 of each of the roller subassemblies to initially unclamp flexible fingers 48 and 49 from engagement with shaft 34, until the precisely desired position is attained. Then screw means 50 is tightened, securely clamping fingers 48 and 49 to shaft 34 in the precisely desired orientation.

Once in the desired position, assurance is provided that each of the roller subassemblies 30, 31, and 32 are individually spaced away from roller/drum 27 with the precisely desired distance, equivalent to the thickness established by four sheets of paper. In this way, roller subassemblies 30, 31, and 32 allows envelopes having two sheets of contents to pass between roller/drum 27 and roller subassemblies 30, 31, and 32 without causing shaft 34 to be arcuately moved. However, any envelope passing therebetween having a localized thickness greater than four sheets of paper will cause roller subassemblies 30, 31, or 32 to be arcuately moved away from roller/drum 27, causing shaft 34 to pivot about its central axis.

In the preferred embodiment, roller/disk subassembly 33 is adjusted on shaft 34 by loosening screw means 67 and positioning roller/disk 56 in contact with the outer surface of roller/drum 27. Once in the precisely desired, touching contact with roller/drum 27, roller/disk subassembly 33 is securely mounted in this position to shaft 34 by tightening screw means 67, causing flexible fingers 65 and 66 to be in secure, affixed, mounted interengagement with shaft 34. Once mounting plate 57 has been securely affixed to shaft 34 in the precisely desired position, envelope sensing section 21 of the present invention is ready for operation.

In this preferred embodiment and configuration, envelope sensing section 21 is able to completely process all envelopes passing between roller/drum 27 and upper multiple element gauging assembly 28, evaluating each envelope and determining whether the envelope should proceed to normal processing or be outsorted for special handling. In its typical configuration, all envelopes containing two sheets of paper, typically a check and a statement, are allowed to continue through the automated envelope handling system for normal processing. However, all other envelopes, namely envelopes with one or no contents, envelopes with three or more sheets of paper, or envelopes containing coins, paper clips, credit cards, staples, etc., are outsorted for special handling.

In order to attain these desired sorting capabilities, thickness detection system 20 of the present invention incorporates electronic sensing means capable of providing the desired analysis. The details of construction and operation for the electronics of the present invention are detailed below. However, the following discussion summarizes the overall operation of the present invention.

As the envelopes to be processed by thickness detection system 20 of the present invention pass through envelope sensing section 21, the thickness of each envelope is determined by upper, multiple-element gauging assembly 28, with the movement of the roller subassemblies forming multiple-element gauging assembly 28 providing an input to LVDT system 80, which is translated into a voltage signal representing the thickness measured by gauging assembly 28. Preferably, four adjustable threshold levels are programmed into the thickness detection system for use in comparison with the measured voltage of each envelope. The preferred four adjustable threshold levels comprise (1) the edge threshold, which would be lower than an envelope with one sheet of paper contained therein; (2) a low threshold, which would be higher than an envelope with one sheet of paper but lower than an envelope with two sheets of paper; (3) a high threshold, which would be higher than an envelope with two sheets of paper but lower than an envelope with three sheets of paper; and (4) a credit card threshold, which would be higher than an envelope with two sheets of paper but lower than an envelope with coins, paper clips, or a credit card contained therein.

In addition to being used for comparison levels with the measured thickness of an envelope, the edge threshold level is also used to detect both the leading edge and trailing edge of the envelope as the envelope is processed through sensor section 21. This construction also enables the detection time or transferral time of each envelope to be directly measured.

Although the outsort parameters and conditions, which are fully detailed below, can be varied to provide any desired sensing arrangement, thickness detection system 20 of the present invention typically incorporates electronic circuitry which causes the automatic outsorting of any envelope producing a voltage signal which exceeds the credit card threshold. Since this thickness level is not typically capable of being generated by construction seams of the envelope or labels, stamps, etc., it is most likely that the envelope having a thickness exceeding the credit card threshold contains material which should be specially handled. Consequently, all envelopes exceeding the credit card threshold are preferably automatically outsorted,regardless of the length of time the high thickness level is detected.

In most other instances, when the voltage signal never exceeds the credit card threshold, the actual detection time is divided into a plurality of separate intervals, representing different portions of the envelopes. Usually, four separate and distinct intervals are employed, with the first and third intervals being by-pass intervals which have no effect on the outsorting of the envelopes. In this way, the passage of the leading edge of the envelope and the central section of the envelope through the sensing section is achieved without affecting any outsort determination. However, the second and fourth intervals typically represent the two detection and analysis intervals employed to determine whether the envelope should be specially handled or forwarded for normal processing.

During these two detection intervals, the voltage signal generated is measured and compared to the high and low thresholds, while the duration of each change in thickness is measured and compared to a predetermined clock pulse length. In this way, anomalies being measured for short time durations can be ignored, while any extraordinary thickness detection which lasts for an extended time period causes the envelope to be outsorted.

Furthermore, this system is preferably constructed to also measure the overall length of the envelope by timing the leading and trailing edges of the envelope. In this way, envelopes exceeding a predetermined length are automatically outsorted for special handling.

Preferably, the length detection is made by employing a second series of clock pulses independent from the clock pulses mentioned above in regard to thickness detection. Based upon the preferred clock pulse signal, it has been found that if clock pulse count ever exceeds, 14, the envelope can be considered as too long and automatically be outsorted. However, by adjusting the length of the pulses employed for counting purposes, the maximum acceptable envelope length can be varied to conform to any desired length or particular application requirements.

In order to provide thickness detection system 20 of the present invention with the ability to properly direct all envelopes to either normal processing or to outsorting, thickness detection system 20 incorporates envelope sorting section 22. By referring to FIGS. 1, 2, 9, and 10, along with the following detailed disclosure, the construction and operation of envelope sorting system 22 can best be understood.

As discussed above, envelope sorting section 22 is positioned at the distal end of transfer surface 25 for receiving and directing the movement of envelope passing through roller/drum 27 and upper multiple-element gauging assembly 28. Since lower roller/drum member 27 is continuously rotated, envelopes passing in contact therewith are initially driven along transfer surface 25, while being restrained from unwanted upward movement by transfer shield 26. In the preferred construction, each envelope is advanced along transfer surface 25 by roller assemblies which carry the envelope along the entire length of transfer surface 25, coming to rest in envelope sorting section 22.

In the preferred embodiment, transfer section 22 incorporates end wall 101 and side wall 102. In normal operation, each of the envelopes transferred along transfer surface 25 comes to rest adjacent end wall 101 and side wall 102. In addition, transfer section 22 also incorporates sensors 120 and 121 positioned above transfer surface 25 to detect the presence of an envelope in transfer section 22.

In order to transfer each envelope in the precisely desired direction, envelope sorting section 22 also comprises lower rollers 103 and 104 which are rotationally driven by motor 105 through driven belt 106. In order to provide the desired rotational movement to rollers 103 and 104, both rollers are rotationally driven by shafts 107, 107 and pulleys 108, 108. In the preferred embodiment, both rollers 103 and 104 are continuously driven by being interconnected with drive belt 106, thereby enabling motor 105 to drive both rollers 103 and 104 in the desired rotational direction.

Figure 10:
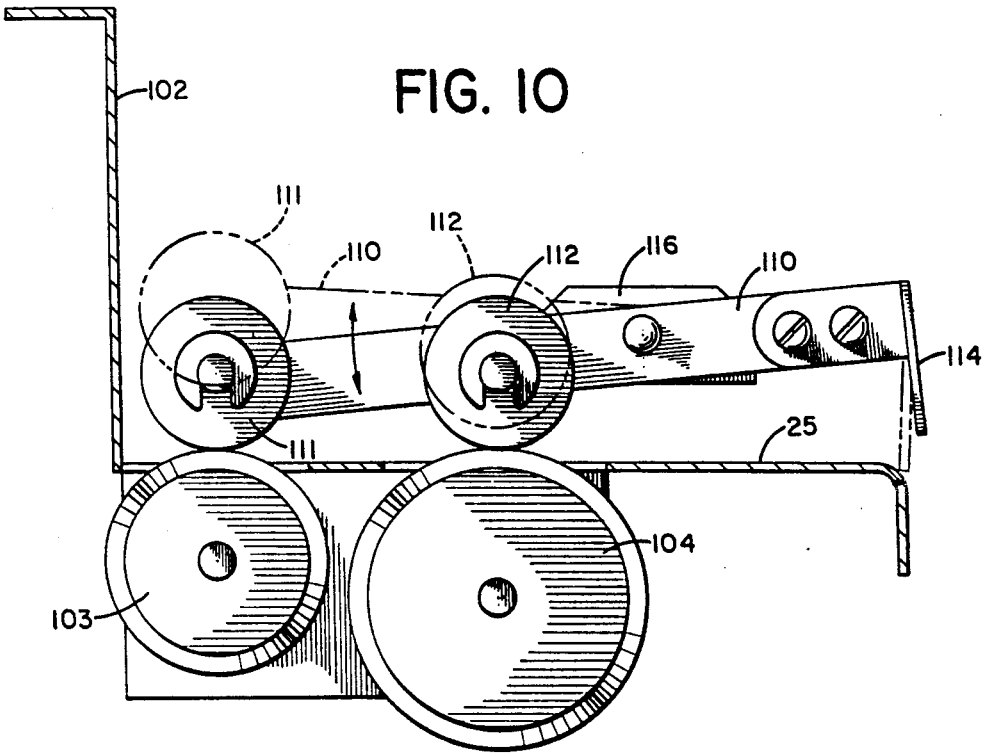
FIG. 10 is an end elevation view of the envelope sorting section shown in FIG. 9, taken along line 10—10 of FIG. 9.

As best seen in FIG. 10, rollers 103 and 104 are positioned below transfer surface 25, with a small portion of the outer peripheral surface of each roller 103 and 104 protruding above surface 25. In addition, rollers 103 and 104 are positioned directly adjacent side wall 102 in spaced position relative to side wall 102 and end wall 101 to assure that each and every envelope transferred along surface 25 will be positioned overlying rollers 103 and 104.

The construction of envelope sorting section 22 is completed by incorporating pivot bar 110 on which two pinch rollers 111 and 112 are mounted. As best seen in FIG. 10, pinch rollers 111 and 112 are positioned along bar 110 in juxtaposed, spaced cooperating alignment with lower rollers 103 and 104.

Bar 110 also incorporates a depending, envelope restraining flange 114 mounted at one end of pivot bar 110, positioned to align dependent flange 114 with the side edge of transfer surface 25 in a manner which prevents any envelopes from being advanced off of transfer surface 25 while pivot bar 110 is in its substantially horizontal position. In this way, any envelope resting on rollers 103 and 104 are prevented from being moved from that position when not desired.

In order to provide pivot bar 110 with the desired arcuate movability, pivot bar 110 is affixed to elongated shaft 115. In this embodiment, shaft 115 is rotationally mounted in the desired position by holding assembly 116 and in constructed for being responsive to the activation of a solenoid (not shown) which causes shaft 115 to rotate.

By employing this construction, whenever the solenoid receives an actuation signal, shaft 115 is rotated about its central axis and pivot bar 110 is simultaneously pivoted about the axis of shaft 115. In addition, the movement of bar 110 causes pinch rollers 111 and 112 to move from a substantially horizontal position (depicted in FIG. 10 in phantom) to the lowered contacting position (shown in solid in FIG. 10) wherein roller 111 is brought into rotational contacting engagement with roller 103 and roller 112 is brought into engagement with roller 104.

As is more fully detailed below, whenever an envelope is positioned in envelope sorting section 22, the envelope is retained in that position, incapable of being moved even when rollers 103 and 104 are rotationally driven. This position is maintained since no force causes the envelope to be moved off of the rotating rollers. In addition, when rollers 103 and 104 are in motion, they are normally rotating in a direction attempting to propel the envelope towards flange 114. However, flange 114 prevents any movement of the envelope off of transfer surface 25.

When actual transferral of the envelope to a desired section of the mail processing system is desired, the solenoid is activated, causing shaft 115 to rotate, which also causes pivot bar 110 to arcuately move, bringing pinch rollers 111 and 112 into contact with rollers 103 and 104. Once rollers 111 and 112 are lowered, any envelope positioned upon rollers 103 and 104 is forced into contacting engagement with rollers 103 and 104, causing the envelope to be immediately propelled in the direction of travel of rollers 103 and 104. In addition, since the arcuate movement of pivot bar 110 simultaneously causes flange 114 to be raised, the transferral of the envelope off of surface 25 in the direction of flange 114 is easily attained.

In normal operation, most envelopes are transferred to envelope sorting section 22 and placed in overlying contact with rotating rollers 103 and 104, with sensors 120 and 121 transmitting a signal to indicate the presence of the envelope. As long as the envelope has passed all of the preset conditions for transferral to normal processing, shaft 115 will be activated while rollers 103 and 104 are rotated in a clockwise direction, and viewed in FIG. 10 As detailed above, 103 and 104 are controllably rotated by motor 105 through drive belt 106.

Since the arcuate movement of shaft 115 causes pivot bar 110 to be lowered, pinch rollers 111 and 112 are brought into contact with the envelope overlying rollers 103 and 104, forcing the envelope into driving contacting engagement with rollers 103 and 104. This causes the envelope to be propelled off of envelope transfer surface 25 below flange 114.

In normal operation, this process continues as each envelope is transferred from the envelope sensing section 21 to the envelope sorting section 22. In this way, each and every envelope meeting the thickness detection standards are efficiently handled and transferred from thickness detection system 20 of this invention to the remainder of the mail handling and processing system to which the thickness detection system has been cooperatively mounted. As a result, all of the envelopes meeting the preset standards for thickness and outsorting are quickly and efficiently transferred to the system for normal processing.

In those instances when an envelope passing through envelope sensing section 21 fails to meet the predefined criteria for normal processing, the envelope is transferred in the manner detailed above from envelope sensing section 21 to envelope sorting section 22. However, in this instance, before shaft 115 is pivoted to enable pivot bar 110 to lower rollers 111 and 112 into contact with rollers 103 and 104, the control circuitry of this system transmits a reverse signal to motor 105 causing the motor to rotate in the opposite direction, thereby driving belt 106 to move in its opposite direction, which automatically causes rollers 103 and 104 to similarly rotate in the opposite direction. As viewed in FIG. 10, in this instance, rollers 103 and 104 rotate in a counterclockwise direction.

Once motor 105 has been activated to rotate in the opposite direction, shaft 115 is then activated to pivot, causing pivot bar 110 to lower, bringing pinch rollers 111 and 112 into contact with rollers 103 and 104, as described above. However, in this instance, the movement of rollers 111 and 112 causes the envelope to contact rollers 103 and 104 and be driven in the opposite direction, away from flange 114 and through open slot 118 formed in side wall 102. In this way, any envelope failing the normal processing criteria is quickly and efficiently outsorted to an alternate retention zone behind side wall 102 where such envelopes can be retained for subsequent manual processing.

As is apparent from the preceding description, thickness detection system 20 of this invention efficiently, accurately, and dependably provides a precise measurement of each and every envelope processed therethrough and quickly and efficiently transfers the envelope to either normal processing or a separate zone for special processing. As a result, by employing the thickness detection system of this invention, all of the difficulties found in prior art systems are overcome and an efficient, reliable, dependable and accurate thickness detection system is realized.

Figure 11:
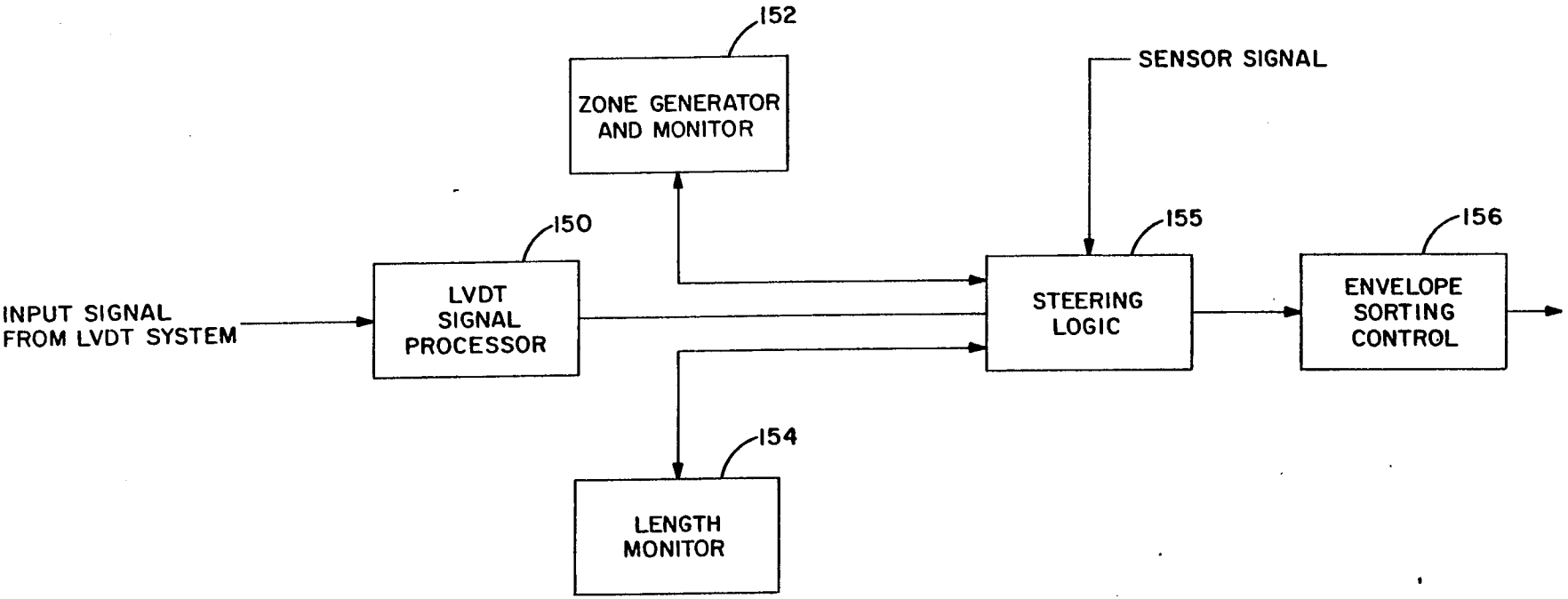
FIG. 11 is a schematic block diagram of the electronic control assembly for the thickness detection system of the present invention.

In FIG. 11, a schematic block diagram of the electronic control assembly for the thickness detection system of the present invention is provided. The functional block diagram shown therein details the electronic components employed in the present invention to process the data received and provide an output signal to the envelope sorting section.

As detailed above, LVDT system 80 produces an output signal representing the thickness measured by gauging assembly 28 of envelope sensing section 21. As shown in FIG. 11, this signal is transmitted to LVDT signal processor 150.

In the preferred embodiment LVDT signal processor 150 incorporates the four desired preset voltage levels corresponding to the presence of the envelope, the low threshold level, the high threshold level, and the credit card threshold level. Whenever the input signal from the LVDT system exceeds the envelope presence threshold level, LVDT signal processor 150 outputs a signal to envelope zone generator and monitor 152, steering logic 155 or length monitor 154.

In the preferred embodiment, zone generator and monitor 152 provides a plurality of functions which can be altered as preset conditions by the operator, depending on the envelope construction being employed. One of the functions provided by the zone generator and monitor 152 is to establish by-pass zones and detection zones for monitoring only the desired portions of the envelope.

As detailed above, the preferred embodiment allows the user to establish two separate and distinct by-pass zones and two separate and distinct detection zones for monitoring the contents of each envelope. In addition, in order to enable the system of this invention to be universally employed with virtually all envelope sizes and shapes, the duration of each of the zones is completely controllable and variable. In this way, any envelope construction can be easily handled by thickness detection system 20 of the present invention.

In addition to controlling and monitoring the zones of each envelope, zone generator and monitor 152 also incorporates a clock pulse signal generator and counter which is activated whenever either the high thickness/-voltage threshold signal is exceeded or the low thickness/voltage threshold is not reached. In this way, the duration of any outsort potential signal is measured throughout the entire envelope detection zones, thereby establishing a highly reliable and accurate configuration for assuring that an actual outsort condition exists, and not an unimportant, minor envelope aberration.

As shown in FIG. 11, the LVDT signal processor also transmits a signal to length monitor 154 which incorporates an adjustable clock pulse signal generator and counter for determining the overall length of each envelope. Once length monitor 154 has been preset for monitoring the desired envelope length, any envelope exceeding the desired length will automatically be outsorted by transmission of an outsort signal to steering logic 155 and outsort control 156 whenever the counter receives pulse signals exceeding the preset level.

The final signal transmitted by the LVDT signal processor is a credit card outsort signal, which is sent to steering logic 155 and outsort control 156 whenever the credit card threshold is exceeded. In the preferred construction, any time an envelope thickness is detected which exceeds this preset threshold level, in terms of pulse count, an automatic envelope outsort signal is generated and is provided by outsort control 156.

Whenever zone generator and monitor 152 receives a signal that the thickness of the envelope is outside of either the high threshold level or the low threshold level, zone generator and monitor 152 begins counting the clock pulse signals to determine the length of time the content problem signal is detected. By counting the clock pulse signals only when a high or low thickness threshold level signal has been detected in the detection window, the time duration of a possible outsort condition in the desired detection zone is measured and, if the outsort condition exists for a length of time exceeding the preset level, zone generator and monitor 152 transmits an outsort signal to steering logic 155 and outsort control 156.

As detailed above, outsort control 156 receives the signals from steering logic 155 indicating that a particular envelope is to be outsorted. These input signals are processed and the requisite control signal is transmitted to envelope sorting section 22 to cause the envelope to be outsorted.

Envelope sorting control 156 also controls the transferral of envelopes meeting all the preset thickness and length conditions and transmits the requisite signal to envelope sorting section for advancing the envelope to normal processing. In this regard, whenever an envelope has been transferred through envelope sensing section 21, without any outsort condition being detected, envelope sorting control 156 receives a signal from sensors mounted in envelope sorting section 22. This sensor signal is transmitted through steering logic 155 and indicates that an envelope has been received in the sorting section and awaits further processing.

Without any error condition having been detected, envelope sorting control 156 outputs a signal to motor 105 of envelope sorting section 22 for advancing the envelope to normal processing. Once motor 105 has been activated, a solenoid is also activated, causing shaft 115 to pivot about its central axis, bringing pinch rollers 111 and 112 into contact with the envelope, thereby causing the envelope to frictionally engage lower rollers 103 and 104, as detailed above. In this way, the envelope positioned between pinch rollers 111 and 112 and lower rollers 103 and 104 is forced to move in the desired direction. In addition, this sensor signal also serves as a reset signal for resetting the circuit to process the next envelope.

In those situations when envelope sorting control 156 receives a signal requiring the envelope to be outsorted, envelope outsort control 156 transmits a signal to motor 105, causing the motor to rotate in the opposite direction, causing the envelope to move into the outsort zone. This outsort is achieved when envelope sorting control 156 outputs a separate signal to the solenoid causing the pinch roller to be lowered, and the envelope to be frictionally engaged with rollers 103 and 104. In this way, the present system effectively and efficiently monitors all envelopes being processed and consistently and dependably transmits the processed envelopes to either normal processing or outsorting.

Figure 12:
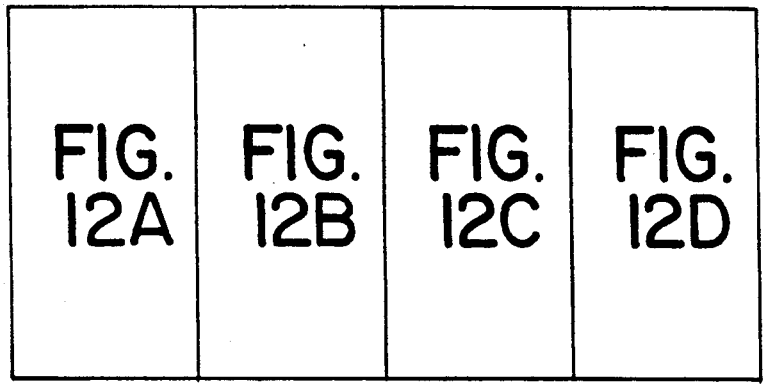
FIG. 12, which is composed of FIGS. 12A, 12B, 12C and 12D, is a detailed schematic diagram of the electronic assembly of the thickness detection system of the present invention.
Figure 12A:
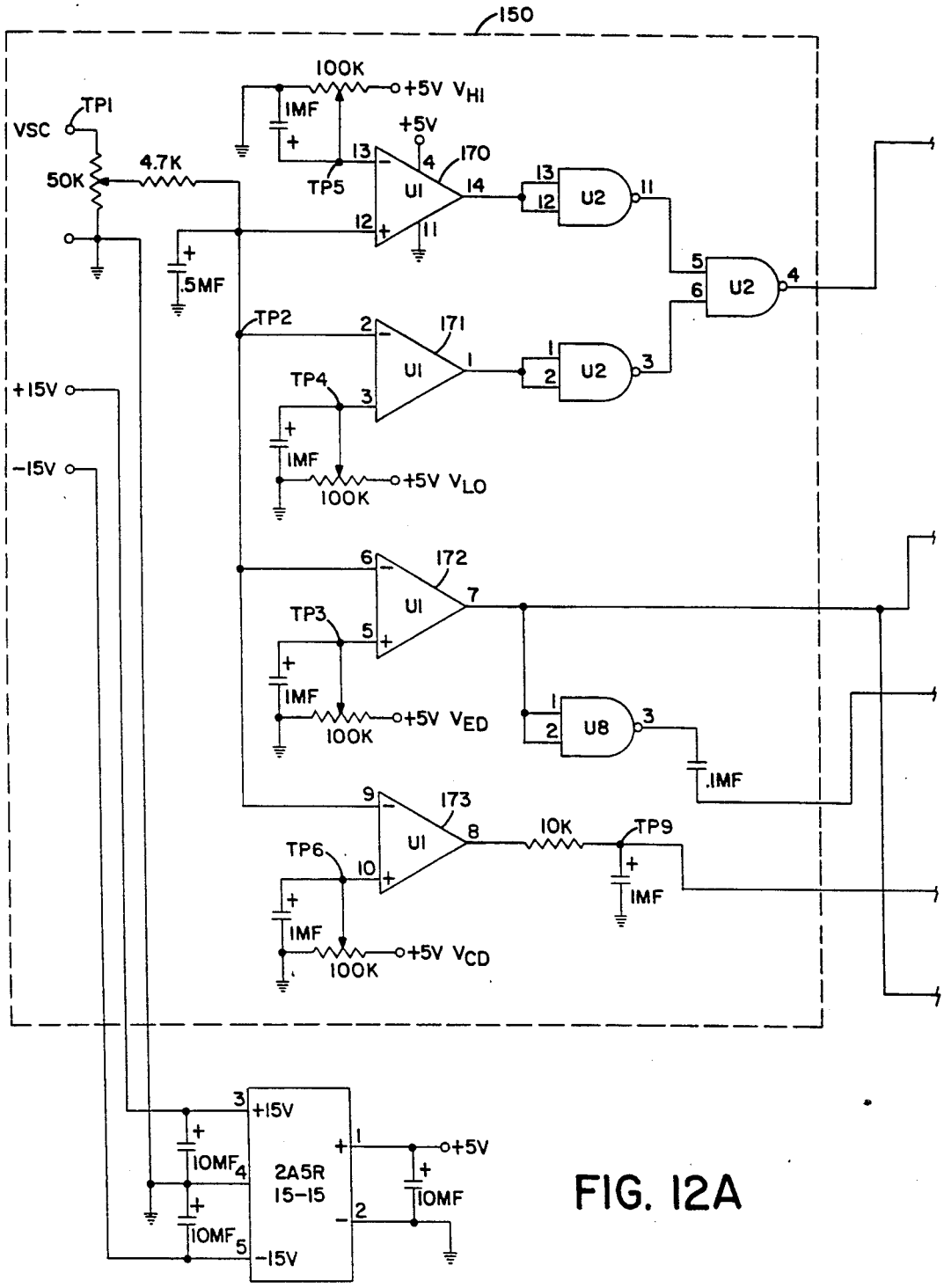
Figure 12B:
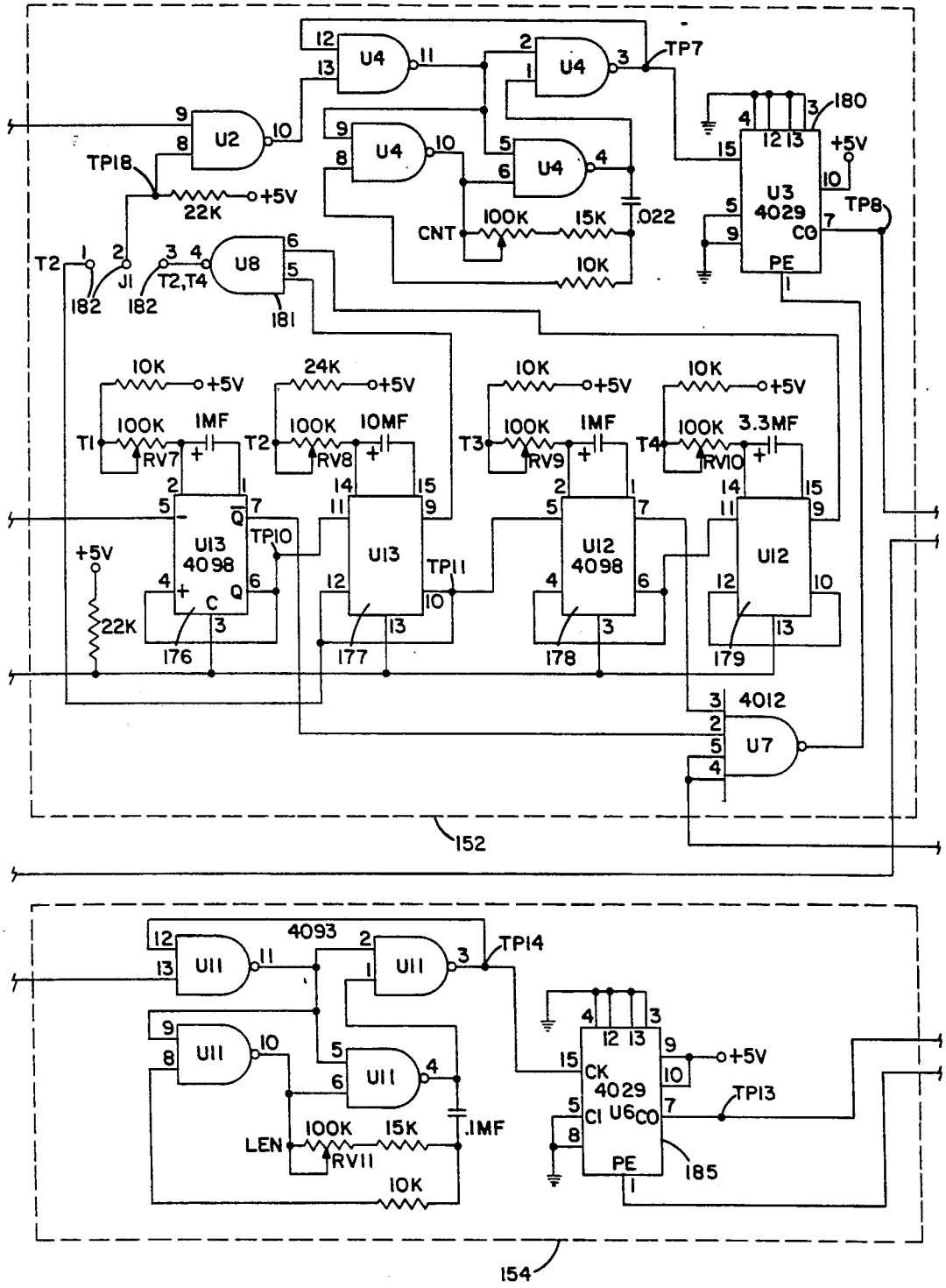
Figure 12C:
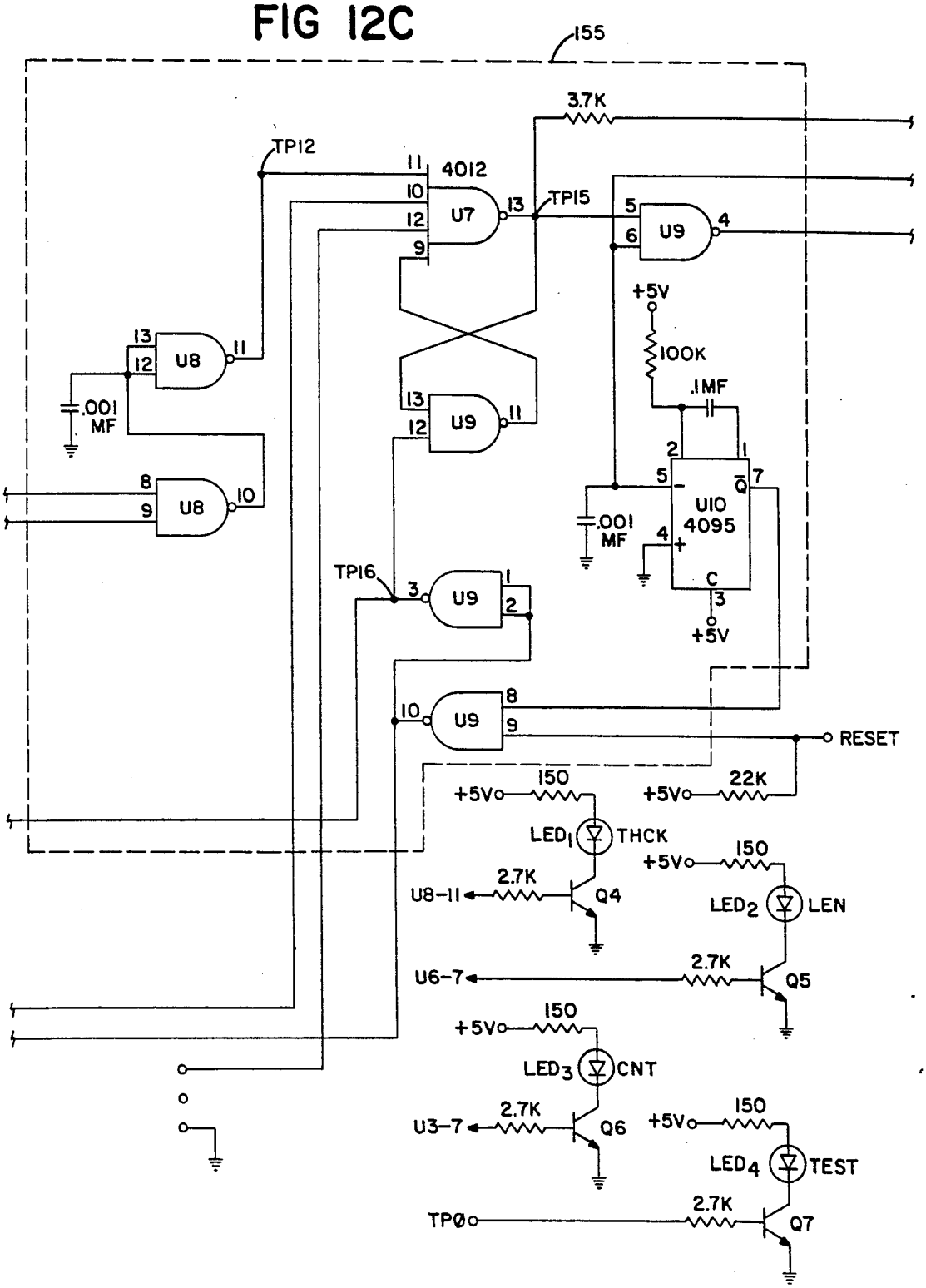
Figure 12D:
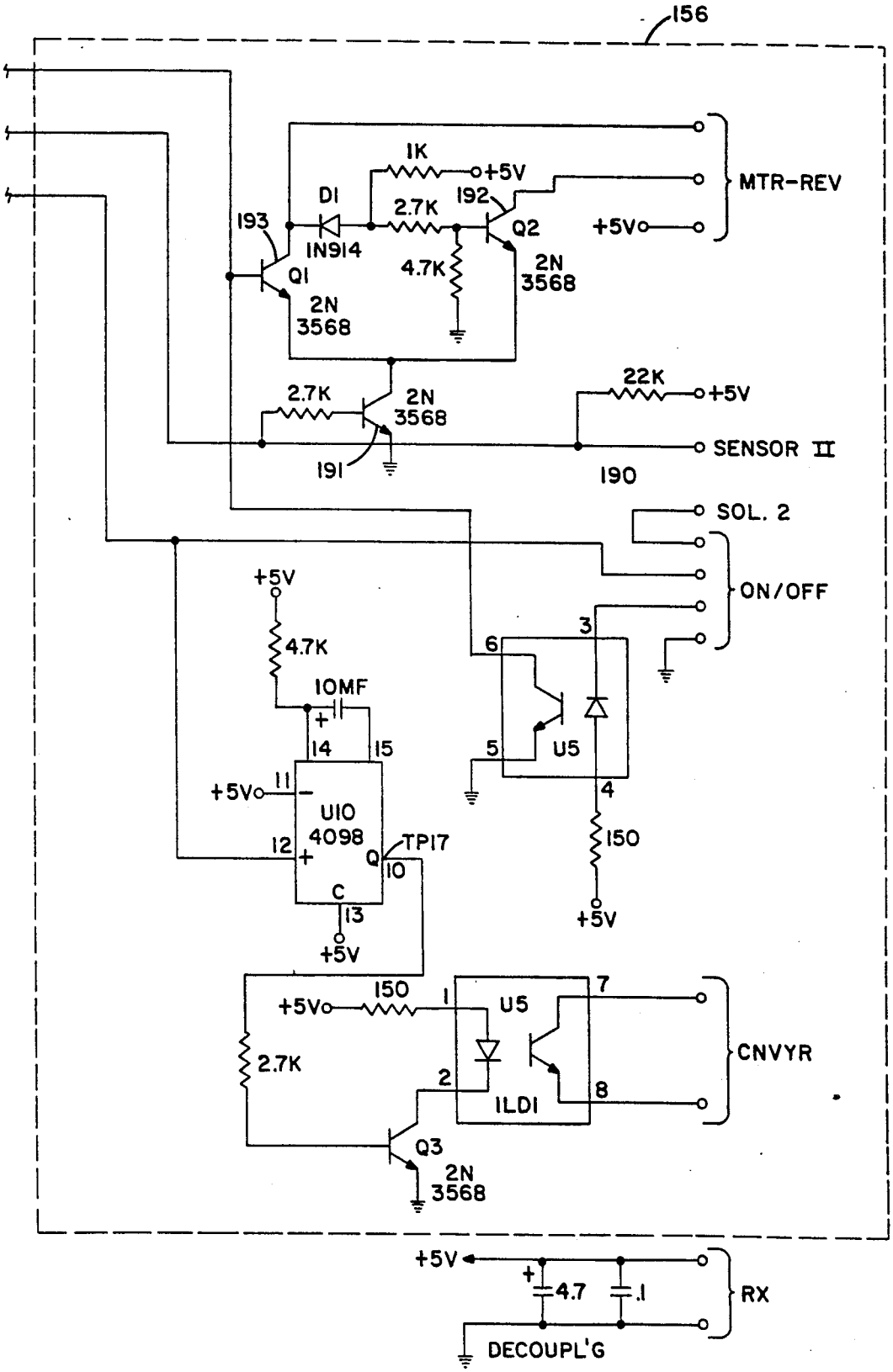

By referring to FIG. 12 along with the following discussion, further amplification of the operation of the present invention will be apparent. Although the foregoing detailed disclosure provides a full and complete teaching of the present invention, the following discussion further amplifies the operation of the present invention.

As shown in FIG. 12, LVDT signal processor 150 comprises four separate and independent comparators 170, 171, 172, and 173. Each of these comparators comprises two inputs, with one input of each comparator connected to an adjustable potentiometer for setting a desired voltage level for comparison.

In this embodiment, the potentiometer associated with comparator 170 is set at the high voltage level threshold, which is higher than the voltage generated by an envelope with two sheets of paper but lower than the one generated by an envelope with three sheets of paper. The potentiometer associated with comparator 171 is set at the low voltage level threshold, which is higher than the voltage generated by an envelope with one sheet of paper, but lower than the one generated by an envelope with two sheets of paper.

The potentiometer associated with comparator 172 is set to detect the envelope presence threshold. Consequently, this potentiometer is set at a level lower than the voltage level of an envelope with one sheet of paper contained therein. Finally, the potentiometer associated with comparator 173 is set at the credit card voltage threshold, which is higher than an envelope with two sheets of paper but lower than an envelope with coins, paper clips, or a credit card contained therein.

Any signals being transmitted from the LVDT system are transmitted to comparators 170, 171, 172, and 173 for comparison with the preset voltage levels associated therewith. Whenever any of these comparators receives a signal from the LVDT system which exceeds the preset potentiometer voltage level, the comparator outputs a signal for further processing.

As shown in FIG. 12, the output signals from comparators 170 and 171 are fed to gates associated therewith to produce a content problem detected signal indicating that an outsort condition might exist. This content problem detected signal is transmitted to zone generator and monitor 152.

Whenever comparator 172 detects the presence of an envelope, output signals are transmitted to both zone generator and monitor 152 and length monitor 154. As detailed herein, the circuitry contained in these two monitors employs these signals for resetting the monitor, at the trailing edge of the envelope and for monitoring the envelope contents or thickness as the envelope passes through sensing section 21.

Finally, comparator 173 produces an output signal whenever the LVDT system signal produces a voltage exceeding the preset credit card threshold level. In the preferred construction, any time the credit card threshold level is exceeded, an outsort signal is generated. Consequently, the output signal from comparator 173 is transmitted directly to the gates forming steering logic 155 for subsequent transmission to the motor control circuitry of envelope sorting control 156. As detailed herein, envelope sorting control 156 produces control signals to cause the envelope to be outsorted.

In order to provide the system of the present invention with the flexibility of designating separate and distinct portions of the envelope as either bypass zones or detection zones, zone generator and monitor 152 incorporates IC's 176, 177, 178, and 179. In addition, the plurality of gates designated as U4 along with the associated potentiometer constitute a clock generator which produces a series of timing pulses at preset intervals. This clock generator cooperates with counter 180 to provide the requisite time interval control circuitry for monitoring the length of time any content problem detected signal is generated.

In the preferred embodiment detailed in FIG. 12, the circuitry of the present invention employs the leading and trailing edge signal generated by comparator 172 to initiate and reset IC's 176, 177, 178, and 179. In addition, each of the IC's outputs a single pulse for the precisely desired time interval established in each IC by its associated potentiometer.

As depicted, IC's 176 and 178 form the bypass zones, while IC's 177 and 179 control the detection zones. As a result, the output signals from IC's 177 and 179 are directed to gate 181 for controlling the transmission of clock pulse signals from the clock generator to counter 180.

In this preferred construction, the clock generator circuit produces a series of clock pulses of a constant length with counter 180 set for producing an output signal whenever a pulse count of 10 is reached. By connecting jumper pins 182 in the desired manner, the requisite IC's 176, 177, 178, and 179 are either activated or deactivated, depending upon the configuration being employed.

In operation, the clock pulses are transmitted to counter 180 when either IC 177 or 179 is activated and either comparator 170 or 171 produces an output signal. In this way, clock pulse signals are counted in order to determine the length of time that a thickness or content detection signal is generated when the envelope's detection zone is being sensed. Whenever counter 180 reaches the preset pulse count, an output signal is transmitted to the steering logic 155 to activate envelope outsorting control 156 to cause the envelope to be outsorted for special handling.

Another outsort condition employed in this invention is excessive envelope length. In order to monitor the envelope length, this invention incorporates length monitor 154, which comprises a clock generating circuit and a counter 185. Length monitor 154 operates in a manner similar to the clock generator described above by generating a series of clock pulses of a constant length when activated by the receipt of the signal from comparator 173 indicating the leading edge threshold as being detected.

These clock pulse signals are transmitted to counter 185 which counts the signals up to a preset limit before transmitting an output signal. In the preferred embodiment, counter 185 counts up to 14 pulses before transmitting an outsort signal due to the envelope having an excessive length. However, counter 185 is adjustable, so that any desired envelope configuration or construction can be properly accommodated. Whenever counter 185 receives clock pulses exceeding its preset limit, an output signal is transmitted to steering logic 155 which transmits a signal to envelope sorting control 156 for outsorting the envelope.

In the preferred operation, envelope sorting control 156 incorporates a motor control circuit which activates motor 105 contained in sorting section 22 to rotate in the desired direction for transferring the envelope positioned therein in the desired direction. In the preferred construction, input line 190 receives a signal from envelope detections sensors 120 and 121 contained in the sorting section 22 whenever an envelope is present in the desired position above rollers 103 and 104. This signal activates transistors 191 and 192 causing motor 105 to rotate in the direction for transferring the envelope to normal processing.

If steering logic 155 receives an outsort signal from any of its input lines, steering logic 155 transmits an outsort signal to transistor 193 causing motor 105 to rotate in the opposite direction. As a result, rollers 103 and 104 rotate in the opposite direction, causing the envelope positioned thereon to be moved from the rollers to the outsort retention zone. As a result, every envelope transferred from envelope sensing section 21 to envelope sorting section 22 is efficiently transferred to the precisely desired location for subsequent processing.

As detailed in FIG. 12, the preferred embodiment of envelope sorting control monitor 156 also incorporates a plurality of alternate connections and circuit controls for activating an outsort conveyor whenever the outsort signal has been received. In this way, envelopes which are outsorted for later processing can be accumulated and incrementally advanced to assure all envelopes transmitted to that zone are easily accommodated. In addition, sorting control 156 also incorporates various switches for activating or deactivating the thickness detection circuitry and the outsort circuitry.

In operating the thickness detection system of the present invention, flexibility both in its mechanical construction and its electrical configuration has been incorporated in order to enable the system to be capable of operating in virtually in any desired configuration or for any desired envelope construction. In this regard, the circuitry detailed in FIG. 12 incorporates a plurality of test points for being able to monitor and establish precisely desired signal levels. In Table I, each of these test points are identified along with its location, typical wave form, and a description of the function being provided.

TABLE I

| TP# | LOCATION | WAVE FORM | DESCRIPTION |
|---|---|---|---|
| | | TEST POINT AND STATUS INDICATORS DESCRIPTION | |
| TP0 | R32-Q7b | — | "TEST" LED input. Test socket may be connected to various locations. Led will go on if signal is high. |
| TP1-TP6 VOLTAGES ARE REFERENCED TO TYPICAL ENVELOPE WITH TYPICAL SETTING WITHIN DETECTION RANGE. MECHANICAL ADJUSTMENT IS MADE TO HAVE .2 V AT TP2 WHEN NOT RUNNING MAIL. | | | |
| TP1 | CN2-1 | | LVDT output full range signal swing. |
| TP2 | u1-6 | | Scaled down and filtered LVDT signal. |
| TP3 | u1-5 | | Edge detect threshold. |
| TP4 | u1-3 | | Vlo threshold for content detection. |
| TP5 | u1-13 | | Vhi threshold for content detection. |
| TP6 | u1-10 | | Vcd threshold for credit card detection. |
| TP7 | u4-3 | | Clock for content detection. |
| TP8 | u3-7 | Hi to Lo | Outsort due to content is detected. LED "CNT" will go off when the over/under content is detected. |
| TP9 | u8-9 | Hi to Lo | Credit card outsort signal. |
| TP10 | u13-6 | +ve pulse | Set RV7 "T1" to the pulse length equals the leading edge construction seam width. |
| TP11 | u13-10 | +ve pulse | Content detection time. Set RV8 "T2" to detection duration desired. |
| TP12 | u8-11 | Hi to Lo | Outsort signal due to thickness. |
| TP13 | u6-7 | Hi to Lo | Over length outsort signal. |
| TP14 | u11-3 | Pulse | Length Pulse Signal. |
| TP15 | u7-13 | Hi to Lo | Outsort (any reason). Hi to Lo until cleared. |
| TP16 | u9-3 | Hi to Lo | Clear signal coming from RX reset switch or generated when envelope exiting sensor #2. |
| TP17 | u10-10 | +ve pulse | Conveyor running time pulse. |
| TP18 | u2-8 | +ve pulse | Same at TP11 if single detection window is selected by J1. Otherwise will indicate both detection windows. |

As is apparent from a review of Table I, along with the circuitry detailed in FIG. 12, the thickness detection system of this invention is completely flexible and adjustable for accommodating virtually any desired envelope configuration or construction. Clearly, the thickness detection system of the present invention overcomes all of the prior art difficulties and establishes a detection system which is reliable, consistent, and completely flexible in attaining a universally applicable system for efficiently and accurately outsorting only those envelopes falling outside of the precisely defined criteria established by the user. As a result, all envelopes conforming to the normal processing standards are efficiently transmitted for normal processing while only those envelopes which require special handling are outsorted.

It will thus be seen that the objects set forth above, among those made apparent from the preceding description, are efficiently attained and, since certain changes may be made in the above constructions without departing from the scope of this invention, it is intended that all matter contained in the above description or shown in the accompanying drawings shall be interpreted as illustrative and not in a limiting sense.

It is also to be understood that the following claims are intended to coverall of the generic and specific features of the invention herein described and all statements of the scope of the invention which, as a matter of language, might be said to fall therebetween.

Having described our invention, what we claim as new and desire to secure by Letters Patent is:

1. An envelope handling system for receiving and sorting envelopes based upon pre-selected criteria for envelope thickness and length, said system comprising A. an envelope sensing section comprising first and second cooperating gauging members for measuring the thickness of each envelope passing therebetween, the first gauging members comprising a. an elongated support shaft constructed for arcuate movement in response to the thickness of the envelope passing between the gauging members, and b. a plurality of separate and independent roller assemblies, each being individually 1. supportingly and adjustably mounted to the elongated shaft at any desired arcuate position relative thereto, and 2. movably positionable and securely affixable to the shaft at any desired axially disposed position along the length, of the shaft, whereby envelope thickness-induced movement of the first gauging member relative to the second gauging member causes the elongated shaft to arcuately pivot;

B. means for measuring the arcuate movement of the elongated shaft and for generating an output signal whenever the measured thickness fails to meet preselected criteria; and C. a sorting section cooperatively associated with the sensing section and positioned for receiving all envelopes passing through the sensing section, said sorting section a. incorporating means for advancing the envelopes into either a first, normal processing direction or a second, outsort direction, and b. operatively communicating with the measuring means for receiving the output signal therefrom the controllably advancing the envelope to either normal processing or outsort processing in response to the signal received;

whereby an effective, efficient and reliable envelope handling system achieved which accurately measures the thickness of every envelope, compares the measured thickness to preselected criteria and advances the envelope to either normal processing or special processing based upon the thickness measurement results.

2. The envelope handling system defined in claim 1 wherein each of the plurality of separate and independent roller assemblies forming the first gauging member is further defined as comprising 3. a support plate securely mountable at one end thereof to said elongated shaft, and 4. a cylindrically shaped roller rotationally mounted to the plate at the opposed end thereof.

3. The envelope handling system defined in claim 2, wherein each of the roller assemblies is further defined as comprising an elongated shaft receiving bore formed therein for cooperative peripherally surrounding interengagement with the elongated shaft and bolt means positioned in cooperating relationship with the shaft receiving bore for adjustably clamping the plate to the shaft in the precisely desired position.

4. The envelope handling system defined in claim 3, wherein said first gauging member is further defined as comprising four separate and independent roller assemblies, each of which are mounted to the elongated shaft for positioning the roller contained therein in juxtaposed, spaced, cooperating relationship with the second gauging member.

5. The envelope handling system defined in claim 4, wherein three of said roller assemblies are further defined as comprising roller members of substantially equal overall length and said fourth roller is further defined as comprising a length substantially less than the other roller members.

6. The envelope handling system defined in claim 5, wherein said three equal length rollers each comprise a length equal to between about 25% to 30% of the width of the envelopes being processed and the thin fourth roller member is further defined as comprising an overall length substantially equal to between about 10% to 20% of the length of the other roller members.

7. The envelope handling system defined in claim 6, wherein said second gauging member is further defined as comprising an elongated, substantially cylindrically shaped member positioned for cooperative, rolling alignment with the first gauging member and the roller assembly incorporating the thin roller member is further defined as being arcuately secured to the elongated shaft with the thin roller member in touching contacting engagement with the second gauging member whereby passage of each envelope between the first and second gauging members cause the thin roller bearing roller assembly to move away from the second gauging member by a distance equal to the envelope thickness, while also causing the axial shaft to pivot through an arc corresponding to the envelope's thickness.

8. The envelope handling system defined in claim 7, wherein said three roller assemblies having substantially equal size roller members are further defined as being securely affixed to the elongated shaft with the outer peripheral surface thereof spaced away from the outer peripheral surface of the second gauging member, thereby enabling envelopes having an added thickness due to stamps or mailing labels to pass therebetween without causing the roller assemblies to move away from the second gauging member.

9. The envelope handling system defined in claim 1, wherein said measuring means is further defined as comprising a. a movable arm fixed at one end thereof to the elongated shaft of the first gauging member for movement thereof in response to the arcuate movement of the elongated shaft, and b. a linear variable differential transformer system cooperatingly associated with the moveable arm for measuring any movement thereof and transmitting an envelope thickness output signal corresponding to the measured movement of the arm.

10. The envelope handling system defined in claim 9, wherein said system further comprises D. electronic control means constructed for receiving the envelope thickness output signal from the linear variable differential transformer system, comparing the signal to preselected criteria, and transmitting an envelope outsort signal to the sorting section whenever the signal received fails to meet the preselected criteria, whereby an efficient control system is attained for independently measuring each envelope and comparing the measuring signal to the precisely desired criteria.

11. The envelope handling system defined in claim 10, wherein said electronic control means is further defined as comprising a. means for measuring the length of the envelope and generating an outsort signal whenever the measured length exceeds a preset limit, and b. means for processing the envelope thickness output signal in preselected intervals depending upon the location of the envelope being measured, thereby allowing the user to eliminate zones of the envelope where erroneous signals could be generated and allowing the user to specifically select only precisely desired envelope zones as the area from which the measured thickness is employed for determining whether an outsort signal should be generated.

12. The envelope handling system defined in claim 11, wherein the electronic control means is further defined as comprising c. means for automatically initiating an outsort signal whenever the measured thickness exceeds a preset threshold level, regardless of the zone in which said thickness is detected.

13. The envelope handling system defined in claim 11, wherein said length measuring means is further defined as comprising:

1. clock means for generating pulse signals at preselected time intervals,
2. counter means constructed
   i. for receiving the pulse signals from the clock means and counting the pulse signals received when activated, and
   ii. for generating an outsort signal whenever the pulses received exceed a preset threshold level, and
3. means for activating the counter whenever the leading edge of the envelope is detected and deactivating and resetting the counter whenever the trailing edge of the envelope is detected, whereby a length detection system is attained for accurately measuring the length of every envelope passing through the envelope handling system and outsorting all envelopes exceeding a predesired overall length.

14. The envelope handling system defined in claim 11, wherein said thickness output signal processing means is further defined as comprising 1. clock means for generating a pulse signal at preselected time intervals,
2. counter means constructed
   i. for receiving the pulse signals from the clock means and counting the pulse signals received when activated, and
   ii. for generating an outsort signal whenever the pulses received exceed a preset threshold level,
3. circuit means constructed for generating a detection activation signal in response to the passage of a desired portion of the envelope between the first and second gauging members,
4. means for comparing the thickness output signal to the preselected thickness criteria and generating a criteria failure signal whenever the thickness output signal fails to satisfy the desired criteria levels, and 5. means for receiving the detection activation signal from the circuit means and the criteria failure signal from the comparing means and for transmitting a counter enable signal to the counter means whenever both input signals are present;

whereby a system is achieved for effectively outsorting envelopes only when the thickness of the envelope in a desired area fails to meet the preselected criteria for a preselected length of time.

15. The envelope handling system defined in claim 1, wherein said sorting section is further defined as comprising c. an envelope receiving zone for receiving and holding all envelopes after passage through the envelope sensing section, d. motor means responsive to a motor drive signal for rotating in either a first or a second direction, e. wheel members rotationally driven by the motor means and positioned in the envelope driving zone for cooperating contacting engagement with each envelope, and f. a pinch roller assembly 1. positioned in juxtaposed, spaced cooperating alignment with the wheel members, and 2. movable between a first non-engaged position and a second, envelope contacting position wherein the envelope is sandwiched between the pinch rollers and the wheel members for being advanced by the rotation of the wheel members in the corresponding direction.

16. The envelope handling system defined in claim 15, wherein the sorting section further comprises g. sensor means mounted in the envelope receiving zone for generating an envelope-present signal whenever an envelope reaches said zone, and h. control means communicating with the measuring means and responsive to the envelope-present signal of the sensor means for activating the pinch roller assembly to move from its first position to its second position and the motor means, said motor means being activated to rotate in a first direction when no outsort signal is received and to rotate in its second, opposite direction whenever an outsort signal is received.

17. An envelope handling system for receiving and sorting envelopes based upon pre-selected criteria for envelope thickness and length, said system comprising A. an envelope sensing section comprising first and second cooperating gauging members for measuring the thickness of each envelope passing therebetween;

B. means for generating an envelope thickness output signal whenever the measured thickness fails to meet preselected criteria;

C. a sorting section cooperatively associated with the sensing section and positioned for receiving all envelopes passing through the sensing section, said sorting section a. incorporating means for advancing the envelopes into either a first, normal processing direction or a second, outsort direction, and b. operatively communicating with the measuring means for receiving the output signal therefrom and controllably advancing the envelope to either normal processing or outsort processing in response to the signal received;

D. electronic control means comprising a. means for measuring the length of the envelope and generating an outsort signal whenever the measured length exceeds a preset limit, and b. means for processing the envelope thickness output signal in preselected intervals depending upon the location of the envelope being measured and comprising 1. clock means for generating a pulse signal at preselected time intervals, 2. counter means constructed i. for receiving the pulse signals from the clock means and counting the pulse signals received when activated, and ii. for generating an outsort signal whenever the pulses received exceed a preset threshold level, 3. circuit means constructed for generating a detection activation signal in response to the passage of a desired portion of the envelope between the first and second gauging members, 4. means for comparing the thickness output signal to the preselected thickness criteria and generating a criteria failure signal whenever the thickness output signal fails to satisfy the desired criteria levels, and 5. means for receiving the detection activation signal from the circuit means and the criteria failure signal from the comparing means and for transmitting a counter enable signal to the counter means whenever both input signals are present;

whereby an effective, efficient and reliable envelope handling system is achieved which accurately measures the thickness of every envelope, compares the measured thickness to preselected criteria and advances the envelope to either normal processing or special processing based upon the thickness measurement results.

18. The envelope handling system defined in claim 17, wherein the electronic control means is further defined as comprising c. means for automatically initiating an outsort signal whenever the measured thickness exceeds a preset threshold level, regardless of the zone in which said thickness is detected; and said length measuring means is further defined as comprising:

1. clock means for generating pulse signals at preselected time intervals, 2. counter means constructed i. for receiving the pulse signals from the clock means and counting the pulse signals received when activated, and ii. for generating an outsort signal whenever the pulses received exceed a preset threshold level, and 3. means for activating the counter whenever the leading edge of the envelope is detected and deactivating and resetting the counter whenever the trailing edge of the envelope is detected, whereby a length detection system is attained for accurately measuring the length of every envelope passing through the envelope handling system and outsorting all envelopes exceeding a predesired overall length.

19. An envelope handling system for receiving and sorting envelopes based upon pre-selected criteria for envelope thickness and length, said system comprising A. an envelope sensing section comprising first and second cooperating gauging members for measuring the thickness of each envelope passing therebetween, B. means for measuring the arcuate movement of the elongated shaft and for generating an output signal whenever the measured thickness fails to meet preselected criteria; and C. a sorting section cooperatively associated with the sensing section and positioned for receiving all envelopes passing through the sensing section, said sorting section a. incorporating means for advancing the envelopes into either a first, normal processing direction or a second, outsort direction, and b. operatively communicating with the measuring means for receiving the output signal therefrom and controllably advancing the envelope to either normal processing or outsort processing in response to the signal received;

c. an envelope receiving zone for receiving and holding all envelopes after passage through the envelope sensing section, d. motor means responsive to a motor drive signal for rotating in either a first or a second direction, e. wheel members rotationally driven by the motor means and positioned in the envelope driving zone for cooperating contacting engagement with each envelope, f. a pinch roller assembly 1. positioned in juxtaposed, spaced cooperating alignment with the wheel members, and 2. movable between a first non-engaged position and a second, envelope contacting position wherein the envelope is sandwiched between the pinch rollers and the wheel members for being advanced by the rotation of the wheel members in the corresponding direction, g. sensor means mounted in the envelope receiving zone for generating an envelope-present signal whenever an envelope reaches said zone, and h. control means communicating with the measuring means and responsive to the envelope-present signal of the sensor means for activating the pinch roller assembly to move from its first position to its second position and the motor means, said motor means being activated to rotate in a first direction when no outsort signal is received and to rotate in its second, opposite direction whenever an outsort signal is received.

20. An envelope handling system for receiving and sorting envelopes based upon pre-selected criteria for envelope thickness and length, said system comprising A. an envelope sensing section comprising first and second cooperating gauging members for measuring the thickness of each envelope passing therebetween, the first gauging members comprising a. an elongated support shaft constructed for arcuate movement in response to the thickness of the envelope passing between the gauging members, and b. a plurality of separate and independent roller assemblies, each being 1. supportingly and adjustably mounted to the elongated shaft at any desired arcuate position relative thereto, and 2. movably positionable and securable to the shaft at any desired location along the length thereof, whereby envelope thickness-induced movement of the first gauging member relative to the second gauging member causes the elongated shaft to arcuately pivot;

B. means for measuring the arcuate movement of the elongated shaft and for generating an output signal whenever the measured thickness fails to meet preselected criteria said measuring means comprising a. a movable arm fixed at one end thereof to the elongated shaft of the first gauging member for movement thereof in response to the arcuate movement of the elongated shaft, and b. a linear variable differential transformer system cooperatingly associated with the moveable arm for measuring any movement thereof and transmitting an envelope thickness output signal corresponding to the measured movement of the arm;

C. a sorting section cooperatively associated with the sensing section and positioned for receiving all envelopes passing through the sensing section, said sorting section a. incorporating means for advancing the envelopes into either a first, normal processing direction or a second, outsort direction, and b. operatively communicating with the measuring means for receiving the output signal therefrom and controllably advancing the envelope to either normal processing or outsort processing in response to the signal received;

c. an envelope receiving zone for receiving and holding all envelopes after passage through the envelope sensing section, d. motor means responsive to a motor drive signal for rotating in either a first or a second direction, e. wheel members rotationally driven by the motor means and positioned in the envelope driving zone for cooperating contacting engagement with each envelope, f. a pinch roller assembly 1. positioned in juxtaposed, spaced cooperating alignment with the wheel members, and 2. movable between a first non-engaged position and a second, envelope contacting position wherein the envelope is sandwiched between the pinch rollers and the wheel members for being advanced by the rotation of the wheel members in the corresponding direction, g. sensor means mounted in the envelope receiving zone for generating an envelope-present signal whenever an envelope reaches said zone, and h. control means communicating with the measuring means and responsive to the envelope-present signal of the sensor means for activating the pinch roller assembly to move from its first position to its second position and the motor means, said motor means being activated to rotate in a first direction when no outsort signal is received and to rotate in its second, opposite direction whenever an outsort signal is received, D. electronic control means constructed for receiving the envelope thickness output signal from the linear variable differential transformer system, comparing the signal to preselected criteria, and transmitting an envelope outsort signal to the sorting section whenever the signal received fails to meet the preselected criteria, and comprising a. means for measuring the length of the envelope and generating an outsort signal whenever the measured length exceeds a preset limit comprising
   1. clock means for generating pulse signals at preselected time intervals,
   2. counter means constructed
      i. for receiving the pulse signals from the clock means and counting the pulse signals received when activated, and
      ii. for generating an outsort signal whenever the pulses received exceed a preset threshold level, and
   3. means for activating the counter whenever the leading edge of the envelope is detected and deactivating and resetting the counter whenever the trailing edge of the envelope is detected, b. means for processing the envelope thickness output signal in preselected intervals depending upon the location of the envelope being measured comprising
   1. clock means for generating a pulse signal at preselected time intervals,
   2. counter means constructed
      i. for receiving the pulse signals from the clock means and counting the pulse signals received when activated, and
      ii. for generating an outsort signal whenever the pulses received exceed a preset threshold level,
   3. circuit means constructed for generating a detection activation signal in response to the passage of a desired portion of the envelope between the first and second gauging members,
   4. means for comparing the thickness output signal to the preselected thickness criteria and generating a criteria failure signal whenever the thickness output signal fails to satisfy the desired criteria levels, and
   5. means for receiving the detection activation signal from the circuit means and the criteria failure signal from the comparing means and for transmitting a counter enable signal to the counter means whenever both input signals are present; and c. means for automatically initiating an outsort signal whenever the measured thickness exceeds a preset threshold level, regardless of the zone in which said thickness is detected.

* * * * *